US007905777B2

(12) United States Patent
Muir

(10) Patent No.: US 7,905,777 B2
(45) Date of Patent: Mar. 15, 2011

(54) METHODS AND APPARATUS FOR AUCTIONING AN ITEM VIA A GAMING DEVICE

(75) Inventor: David H. Muir, Warnesbay (AU)

(73) Assignee: IGT, Reno, NV (US)

( * ) Notice: Subject to any disclaimer, the term of this patent is extended or adjusted under 35 U.S.C. 154(b) by 1260 days.

(21) Appl. No.: 11/461,964

(22) Filed: Aug. 2, 2006

(65) Prior Publication Data

US 2007/0032286 A1 Feb. 8, 2007

Related U.S. Application Data

(60) Provisional application No. 60/705,341, filed on Aug. 4, 2005.

(51) Int. Cl.
*A63F 9/24* (2006.01)

(52) U.S. Cl. ..... 463/25; 463/29

(58) Field of Classification Search ..... 463/1, 9, 463/16, 25, 47, 29; 705/37
See application file for complete search history.

(56) References Cited

U.S. PATENT DOCUMENTS

| | | | |
|---|---|---|---|
| 2,068,379 | A | 1/1937 | Frantz et al. |
| 4,009,522 | A | 3/1977 | Borianne |
| 4,093,215 | A | 6/1978 | Ballard |
| 4,093,235 | A | 6/1978 | Barry |
| 4,140,319 | A | 2/1979 | Aycock et al. |
| 4,146,233 | A | 3/1979 | Musolino |
| 4,261,575 | A | 4/1981 | Matthews et al. |
| 4,302,016 | A | 11/1981 | Astle et al. |
| 4,332,386 | A | 6/1982 | Townsend |
| 4,437,670 | A | 3/1984 | Simon |
| 4,440,397 | A | 4/1984 | Butner |
| 4,484,748 | A | 11/1984 | Becze |
| 4,569,526 | A | 2/1986 | Hamilton |
| 4,637,614 | A | 1/1987 | Gibbon et al. |
| 4,666,160 | A | 5/1987 | Hamilton |
| 4,890,842 | A | 1/1990 | Plange |
| 4,890,843 | A | 1/1990 | Chauve |

(Continued)

FOREIGN PATENT DOCUMENTS

EP 1063622 12/2000

(Continued)

OTHER PUBLICATIONS

Auction Fever Advertisement, written by Sierra Design Group, available prior to 2004.

(Continued)

*Primary Examiner* — David L Lewis
*Assistant Examiner* — Robert Mosser
(74) *Attorney, Agent, or Firm* — K&L Gates LLP

(57) ABSTRACT

Methods and apparatus for auctioning an item via a gaming device are disclosed. The methods and apparatus enable a gaming device player (e.g., a slot machine player) to select one or more auction items the player is interested in bidding on. As the player plays the gaming device, a portion of each bet and/or a portion of each win is allocated to an accumulating bid on the selected auction item(s). In one embodiment, other players, connected via a network, also bid on the auction item(s) in a similar fashion. At the end of an auction, the highest bidder is awarded with the auction item. In one embodiment, the auction item is a physical auction item physically displayed at the gaming device.

35 Claims, 9 Drawing Sheets

U.S. PATENT DOCUMENTS

| | | | |
|---|---|---|---|
| 4,900,027 | A | 2/1990 | Sheridan |
| 4,910,775 | A | 3/1990 | Yves et al. |
| 4,926,327 | A | 5/1990 | Sidley |
| 4,927,156 | A | 5/1990 | Breslow et al. |
| 5,011,158 | A | 4/1991 | Roberts et al. |
| 5,076,588 | A | 12/1991 | Minh |
| 5,078,405 | A | 1/1992 | Jones et al. |
| 5,083,271 | A | 1/1992 | Thacher et al. |
| 5,163,687 | A | 11/1992 | Jenkins |
| 5,280,909 | A | 1/1994 | Tracy |
| 5,292,133 | A | 3/1994 | Alexander |
| 5,326,104 | A | 7/1994 | Pease et al. |
| 5,342,056 | A | 8/1994 | Ajaji |
| 5,344,144 | A | 9/1994 | Canon |
| 5,347,306 | A | 9/1994 | Nitta |
| 5,445,391 | A | 8/1995 | Gleason, Jr. |
| 5,539,450 | A | 7/1996 | Handelman |
| 5,542,669 | A | 8/1996 | Charron et al. |
| 5,564,700 | A | 10/1996 | Celona |
| 5,564,701 | A | 10/1996 | Dettor |
| 5,584,485 | A | 12/1996 | Jones et al. |
| 5,592,212 | A | 1/1997 | Handelman |
| 5,611,535 | A | 3/1997 | Tiberio |
| 5,645,486 | A | 7/1997 | Nagao et al. |
| 5,655,961 | A | 8/1997 | Acres et al. |
| 5,668,591 | A | 9/1997 | Shintani |
| 5,695,400 | A | 12/1997 | Fennell, Jr. et al. |
| 5,702,304 | A | 12/1997 | Acres et al. |
| 5,741,183 | A | 4/1998 | Acres et al. |
| 5,749,785 | A | 5/1998 | Rossides |
| 5,752,882 | A | 5/1998 | Acres et al. |
| 5,766,076 | A | 6/1998 | Pease et al. |
| 5,772,509 | A | 6/1998 | Weiss |
| 5,779,547 | A | 7/1998 | SoRelle et al. |
| 5,779,549 | A | 7/1998 | Walker et al. |
| 5,788,235 | A | 8/1998 | Thomas |
| 5,820,459 | A | 10/1998 | Acres et al. |
| 5,830,063 | A | 11/1998 | Brune |
| 5,836,817 | A | 11/1998 | Acres et al. |
| 5,851,149 | A | 12/1998 | Xidos et al. |
| 5,855,515 | A | 1/1999 | Pease et al. |
| 5,876,283 | A | 3/1999 | Parra et al. |
| 5,876,284 | A | 3/1999 | Acres et al. |
| 5,885,158 | A | 3/1999 | Torango et al. |
| 5,890,963 | A | 4/1999 | Yen |
| 5,917,725 | A | 6/1999 | Thacher et al. |
| 5,947,820 | A | 9/1999 | Morro et al. |
| 5,951,011 | A | 9/1999 | Potter et al. |
| 5,957,775 | A | 9/1999 | Cherry |
| 5,997,002 | A | 12/1999 | Goldman |
| 6,001,016 | A | 12/1999 | Walker et al. |
| 6,008,784 | A | 12/1999 | Acres et al. |
| 6,009,458 | A | 12/1999 | Hawkins et al. |
| 6,015,344 | A | 1/2000 | Kelly et al. |
| 6,030,288 | A | 2/2000 | Davis et al. |
| 6,045,447 | A | 4/2000 | Yoshizawa et al. |
| 6,065,752 | A | 5/2000 | Beltran |
| 6,077,162 | A | 6/2000 | Weiss |
| 6,089,980 | A | 7/2000 | Gauselmann |
| 6,110,041 | A | 8/2000 | Walker et al. |
| 6,142,872 | A | 11/2000 | Walker et al. |
| 6,162,122 | A | 12/2000 | Acres et al. |
| 6,165,072 | A | 12/2000 | Davis et al. |
| 6,174,237 | B1 | 1/2001 | Stephenson |
| 6,192,347 | B1 | 2/2001 | Graff |
| 6,200,216 | B1 | 3/2001 | Peppel |
| 6,206,782 | B1 | 3/2001 | Walker et al. |
| 6,210,275 | B1 | 4/2001 | Olsen |
| 6,224,482 | B1 | 5/2001 | Bennett |
| 6,231,445 | B1 | 5/2001 | Acres |
| 6,236,900 | B1 | 5/2001 | Geiger |
| 6,241,608 | B1 | 6/2001 | Torango |
| 6,244,958 | B1 | 6/2001 | Acres |
| 6,254,483 | B1 | 7/2001 | Acres |
| 6,257,981 | B1 | 7/2001 | Acres et al. |
| 6,260,019 | B1 | 7/2001 | Courts |
| 6,293,864 | B1 | 9/2001 | Romero |
| 6,296,569 | B1 | 10/2001 | Congello, Jr. |
| 6,311,976 | B1 | 11/2001 | Yoseloff et al. |
| 6,312,332 | B1 | 11/2001 | Walker et al. |
| 6,312,333 | B1 | 11/2001 | Acres |
| 6,315,660 | B1 | 11/2001 | Demar et al. |
| 6,319,122 | B1 | 11/2001 | Packes, Jr. et al. |
| 6,319,125 | B1 | 11/2001 | Acres |
| 6,336,862 | B1 | 1/2002 | Brune |
| 6,356,539 | B1 | 3/2002 | Zuliani et al. |
| 6,358,147 | B1 | 3/2002 | Jaffe et al. |
| 6,364,768 | B1 | 4/2002 | Acres et al. |
| 6,371,852 | B1 | 4/2002 | Acres |
| 6,375,567 | B1 | 4/2002 | Acres |
| 6,375,568 | B1 | 4/2002 | Roffman et al. |
| 6,375,569 | B1 | 4/2002 | Acres |
| 6,386,975 | B1 | 5/2002 | Peterson |
| 6,409,172 | B1 | 6/2002 | Vancura |
| 6,431,983 | B2 | 8/2002 | Acres |
| 6,435,511 | B1 | 8/2002 | Vancura et al. |
| 6,443,841 | B1 | 9/2002 | Rossides |
| RE37,885 | E | 10/2002 | Acres et al. |
| 6,468,159 | B1 | 10/2002 | La Mura et al. |
| 6,482,089 | B2 | 11/2002 | Demar et al. |
| 6,506,117 | B2 | 1/2003 | Demar et al. |
| 6,508,707 | B2 | 1/2003 | Demar et al. |
| 6,520,855 | B2 | 2/2003 | Demar et al. |
| 6,565,434 | B1 | 5/2003 | Acres |
| 6,565,442 | B2 | 5/2003 | La Mura et al. |
| 6,571,344 | B1 | 5/2003 | Sitnik |
| 6,575,831 | B1 | 6/2003 | Gonen et al. |
| 6,575,832 | B1 | 6/2003 | Manfredi et al. |
| 6,582,302 | B2 | 6/2003 | Romero |
| 6,582,306 | B1 | 6/2003 | Kaminkow |
| 6,585,586 | B1 | 7/2003 | Romero |
| 6,592,459 | B2 | 7/2003 | Parra et al. |
| 6,592,460 | B2 | 7/2003 | Torango |
| 6,607,438 | B2 | 8/2003 | Baerlocher et al. |
| 6,607,441 | B1 | 8/2003 | Acres |
| 6,620,046 | B2 | 9/2003 | Rowe |
| 6,626,758 | B1 | 9/2003 | Parham et al. |
| 6,632,141 | B2 | 10/2003 | Webb et al. |
| 6,632,142 | B2 | 10/2003 | Keith |
| 6,648,753 | B1 | 11/2003 | Tracy et al. |
| 6,652,378 | B2 | 11/2003 | Cannon et al. |
| 6,656,047 | B1 | 12/2003 | Tarantino et al. |
| 6,656,050 | B2 | 12/2003 | Busch et al. |
| 6,659,861 | B1 | 12/2003 | Faris et al. |
| 6,676,513 | B2 | 1/2004 | Gauselmann |
| 6,676,521 | B1 | 1/2004 | La Mura et al. |
| 6,688,973 | B2 | 2/2004 | Satloff et al. |
| 6,688,976 | B1 | 2/2004 | Walker et al. |
| 6,692,354 | B2 | 2/2004 | Tracy et al. |
| 6,709,330 | B1 | 3/2004 | Klein et al. |
| 6,712,697 | B2 | 3/2004 | Acres |
| 6,718,312 | B1 | 4/2004 | Mcafee et al. |
| 6,726,562 | B2 | 4/2004 | Vancura |
| 6,735,324 | B1 | 5/2004 | McKinley et al. |
| 6,745,236 | B1 | 6/2004 | Hawkins et al. |
| 6,746,332 | B1 | 6/2004 | Ing et al. |
| 6,749,510 | B2 | 6/2004 | Giobbi |
| 6,758,746 | B1 | 7/2004 | Hunter et al. |
| 6,758,748 | B2 | 7/2004 | Byrne |
| 6,760,861 | B2 | 7/2004 | Fukuhara et al. |
| 6,767,287 | B1 | 7/2004 | Mcquaid et al. |
| 6,773,344 | B1 | 8/2004 | Gabai et al. |
| 6,796,900 | B2 | 9/2004 | Baerlocher et al. |
| 6,800,030 | B2 | 10/2004 | Acres |
| 6,805,628 | B2 | 10/2004 | Romero |
| 6,811,485 | B2 | 11/2004 | Kaminkow |
| 6,814,664 | B2 | 11/2004 | Baerlocher et al. |
| 6,832,958 | B2 | 12/2004 | Acres et al. |
| 6,835,132 | B2 | 12/2004 | Bennett |
| 6,837,788 | B2 | 1/2005 | Cannon |
| 6,869,076 | B1 | 3/2005 | Moore et al. |
| 6,876,988 | B2 | 4/2005 | Helsper et al. |
| 6,883,803 | B1 | 4/2005 | Barry |
| 6,887,154 | B1 | 5/2005 | Luciano, Jr. et al. |
| 6,896,614 | B2 | 5/2005 | Romero |
| 6,910,964 | B2 | 6/2005 | Acres |
| RE38,812 | E | 10/2005 | Acres et al. |

6,964,608 B1 11/2005 Koza
6,986,711 B2 1/2006 Vancura
6,996,413 B2 2/2006 Inselberg
7,018,292 B2 3/2006 Tracy et al.
7,025,674 B2 * 4/2006 Adams et al. ..... 463/1
7,036,145 B1 4/2006 Murphy et al.
7,040,982 B1 5/2006 Jarvis et al.
7,054,831 B2 5/2006 Koenig
7,056,215 B1 6/2006 Olive
7,058,602 B1 6/2006 La Mura et al.
7,077,746 B2 7/2006 Torango
7,085,740 B1 8/2006 Meyers
7,086,945 B2 8/2006 Vancura
7,107,239 B2 9/2006 Graff
7,130,820 B2 10/2006 Song
7,192,350 B2 3/2007 Nguyen
7,195,560 B2 3/2007 DeMar et al.
7,200,571 B1 4/2007 Jenniges et al.
7,207,563 B2 4/2007 Samberg
2001/0018361 A1 8/2001 Acres
2001/0025252 A1 9/2001 Yoshimoto
2001/0029200 A1 10/2001 Romero
2001/0030395 A1 10/2001 Sunday
2001/0031664 A1 10/2001 Acres
2001/0034635 A1 10/2001 Winters
2001/0034643 A1 10/2001 Acres
2001/0034649 A1 10/2001 Acres
2001/0039206 A1 11/2001 Peppel
2001/0046891 A1 11/2001 Acres
2001/0049625 A1 12/2001 Mowry
2001/0055990 A1 12/2001 Acres
2001/0056396 A1 12/2001 Goino
2002/0002070 A1 1/2002 Romero
2002/0006820 A1 1/2002 Romero
2002/0010015 A1 1/2002 Acres
2002/0013763 A1 1/2002 Harris
2002/0028708 A1 3/2002 Busch et al.
2002/0042300 A2 4/2002 Acres
2002/0058546 A2 5/2002 Acres
2002/0061778 A1 5/2002 Acres
2002/0094869 A1 7/2002 Harkham
2002/0103746 A1 8/2002 Moffett
2002/0107074 A1 8/2002 Lee
2002/0138342 A1 9/2002 Clark et al.
2002/0138594 A1 9/2002 Rowe
2002/0142832 A1 10/2002 Loose et al.
2002/0147045 A1 10/2002 La Mura et al.
2002/0147046 A1 10/2002 Wang
2002/0147675 A1 10/2002 Das et al.
2002/0151342 A1 10/2002 Tracy et al.
2002/0151357 A1 10/2002 Acres
2002/0155870 A1 10/2002 Romero
2002/0155885 A1 10/2002 Shvili
2002/0163122 A1 11/2002 Vancura
2002/0177483 A1 11/2002 Cannon
2002/0178264 A1 11/2002 Benda et al.
2002/0183105 A1 12/2002 Cannon et al.
2003/0018564 A1 1/2003 Bonnier et al.
2003/0027625 A1 2/2003 Rowe
2003/0028779 A1 2/2003 Rowe
2003/0032476 A1 2/2003 Walker et al.
2003/0032480 A1 2/2003 Keith
2003/0033607 A1 2/2003 Schwalb
2003/0036424 A1 2/2003 Baerlocher
2003/0040363 A1 2/2003 Sandberg
2003/0045350 A1 3/2003 Baerlocher et al.
2003/0046221 A1 3/2003 Hora
2003/0054879 A1 3/2003 Schneier et al.
2003/0055713 A1 3/2003 Pinto et al.
2003/0057884 A1 3/2003 Dowling et al.
2003/0060266 A1 3/2003 Baerlocher
2003/0060276 A1 3/2003 Walker et al.
2003/0060279 A1 3/2003 Torango
2003/0064773 A1 4/2003 Baerlocher et al.
2003/0078871 A1 4/2003 Webb
2003/0092484 A1 5/2003 Schneider et al.
2003/0104862 A1 6/2003 Acres
2003/0119570 A1 6/2003 Maroun
2003/0144965 A1 7/2003 Prasad et al.
2003/0148807 A1 8/2003 Acres
2003/0159083 A1 8/2003 Fukuhara et al.
2003/0177347 A1 9/2003 Schneier et al.
2003/0199313 A1 10/2003 Gonen et al.
2003/0211880 A1 11/2003 Locke
2003/0222402 A1 12/2003 Olive
2003/0225615 A1 12/2003 Sumiyoshi
2003/0225617 A1 12/2003 Sumiyoshi
2003/0228904 A1 12/2003 Acres et al.
2004/0002378 A1 1/2004 Acres et al.
2004/0009811 A1 1/2004 Torango
2004/0009817 A1 1/2004 La Mura et al.
2004/0010771 A1 1/2004 Wallace et al.
2004/0010793 A1 1/2004 Wallace et al.
2004/0039677 A1 2/2004 Mura et al.
2004/0043770 A1 3/2004 Amit et al.
2004/0054551 A1 3/2004 Ausubel et al.
2004/0058731 A1 3/2004 Rossides
2004/0072615 A1 4/2004 Maya et al.
2004/0082372 A1 4/2004 Romero
2004/0083154 A1 4/2004 Guler et al.
2004/0097287 A1 5/2004 Postrel
2004/0104530 A1 6/2004 Moe
2004/0106449 A1 6/2004 Walker et al.
2004/0110552 A1 6/2004 Del Prado
2004/0116176 A1 6/2004 Tulley et al.
2004/0143495 A1 7/2004 Koenig
2004/0148221 A1 7/2004 Chu
2004/0180717 A1 9/2004 Vancura
2004/0192437 A1 9/2004 Amaitis et al.
2004/0193489 A1 9/2004 Boyd et al.
2004/0204232 A1 10/2004 Asher et al.
2004/0215548 A1 10/2004 Chieu et al.
2004/0224772 A1 11/2004 Canessa et al.
2004/0229700 A1 11/2004 Cannon et al.
2004/0242294 A1 12/2004 Shiozawa
2004/0242297 A1 12/2004 Walker et al.
2004/0242322 A1 12/2004 Montagna et al.
2004/0248637 A1 12/2004 Liebenberg et al.
2004/0260641 A1 12/2004 Cohen
2004/0267624 A1 12/2004 Nuriel
2005/0004984 A1 1/2005 Simpson
2005/0020342 A1 1/2005 Palmer et al.
2005/0032573 A1 2/2005 Acres et al.
2005/0041161 A1 2/2005 Dowling et al.
2005/0043082 A1 2/2005 Peterson et al.
2005/0043088 A1 2/2005 Nguyen et al.
2005/0049933 A1 3/2005 Upendran et al.
2005/0049957 A1 3/2005 Vakili et al.
2005/0050160 A1 3/2005 Upendran et al.
2005/0050576 A1 3/2005 Upendran et al.
2005/0056700 A1 3/2005 Mckinley et al.
2005/0064937 A1 3/2005 Ballman
2005/0076362 A1 4/2005 Dukes et al.
2005/0079912 A1 4/2005 Hanafusa
2005/0085300 A1 4/2005 Johnson
2005/0091144 A1 4/2005 Longman et al.
2005/0101374 A1 5/2005 Acres
2005/0102215 A1 5/2005 Ausubel et al.
2005/0119047 A1 6/2005 Olive
2005/0125309 A1 6/2005 Song
2005/0143168 A1 6/2005 Torango
2005/0153767 A1 7/2005 Gauselmann
2005/0164792 A1 7/2005 Wilcock
2005/0173054 A1 8/2005 Peterson
2005/0176488 A1 8/2005 Olive
2005/0187004 A1 8/2005 Vancura
2005/0187021 A1 8/2005 Daskalakis
2005/0187873 A1 8/2005 Labrou et al.
2005/0202873 A1 9/2005 Asher et al.
2005/0202874 A1 9/2005 Asher et al.
2005/0209004 A1 9/2005 Torango
2005/0209005 A1 9/2005 Acres et al.
2005/0216391 A1 9/2005 Tews
2005/0239542 A1 10/2005 Olsen
2005/0240318 A1 10/2005 Naoi et al.
2005/0240558 A1 10/2005 Gil et al.
2005/0267834 A1 12/2005 Zetmeir
2005/0269778 A1 12/2005 Samberg

| | | | |
|---|---|---|---|
| 2005/0273417 | A1 | 12/2005 | Budish |
| 2006/0003829 | A1 | 1/2006 | Thomas |
| 2006/0030402 | A1 | 2/2006 | Chandrakumar et al. |
| 2006/0035705 | A1 | 2/2006 | Jordan |
| 2006/0040723 | A1 | 2/2006 | Baerlocher et al. |
| 2006/0040732 | A1 | 2/2006 | Baerlocher et al. |
| 2006/0040733 | A1 | 2/2006 | Baerlocher et al. |
| 2006/0040734 | A1 | 2/2006 | Baerlocher et al. |
| 2006/0040736 | A1 | 2/2006 | Baerlocher et al. |
| 2006/0046817 | A1 | 3/2006 | Paulsen et al. |
| 2006/0046839 | A1 | 3/2006 | Nguyen |
| 2006/0047581 | A1 | 3/2006 | La Mura et al. |
| 2006/0063580 | A1 | 3/2006 | Nguyen et al. |
| 2006/0064184 | A1 | 3/2006 | Ream et al. |
| 2006/0068919 | A1 | 3/2006 | Gottfurcht |
| 2006/0079317 | A1 | 4/2006 | Flemming et al. |
| 2006/0085261 | A1 | 4/2006 | Chu |
| 2006/0085321 | A1 | 4/2006 | Staib et al. |
| 2006/0089188 | A1 | 4/2006 | Romero |
| 2006/0093142 | A1 | 5/2006 | Schneier et al. |
| 2006/0100006 | A1 | 5/2006 | Mitchell et al. |
| 2006/0105827 | A1 | 5/2006 | Metzger et al. |
| 2006/0111979 | A1 | 5/2006 | Chu |
| 2006/0111985 | A1 | 5/2006 | Sheldon et al. |
| 2006/0116194 | A1 | 6/2006 | Pacey et al. |
| 2006/0121971 | A1 | 6/2006 | Slomiany et al. |
| 2006/0123053 | A1 | 6/2006 | Scannell |
| 2006/0135260 | A1 | 6/2006 | Boss et al. |
| 2006/0138728 | A1 | 6/2006 | Gordon et al. |
| 2006/0167784 | A1 | 7/2006 | Hoffberg |
| 2006/0172804 | A1 | 8/2006 | Acres et al. |
| 2006/0178217 | A1 | 8/2006 | Jung et al. |
| 2006/0182258 | A1 | 8/2006 | Sisselman et al. |
| 2006/0183529 | A1 | 8/2006 | Acres et al. |
| 2006/0183547 | A1 | 8/2006 | Mcmonigle |
| 2006/0184989 | A1 | 8/2006 | Slothouber |
| 2006/0189371 | A1 | 8/2006 | Walker et al. |
| 2006/0190392 | A1 | 8/2006 | Samid |
| 2006/0195382 | A1 | 8/2006 | Sung |
| 2006/0211482 | A1 | 9/2006 | Pimienta et al. |
| 2006/0217199 | A1 | 9/2006 | Adcox et al. |
| 2006/0221195 | A1 | 10/2006 | Sohmers |
| 2006/0223616 | A1 | 10/2006 | Tulley et al. |
| 2006/0223617 | A1 | 10/2006 | Tulley et al. |
| 2006/0230158 | A1 | 10/2006 | Fukazawa et al. |
| 2006/0234795 | A1 | 10/2006 | Dhunjishaw et al. |
| 2006/0235745 | A1 | 10/2006 | Yano |
| 2006/0246991 | A1 | 11/2006 | Tulley et al. |
| 2006/0247040 | A1 | 11/2006 | Walker et al. |
| 2006/0247056 | A1 | 11/2006 | Luckerson |
| 2006/0252476 | A1 | 11/2006 | Bahou |
| 2006/0258429 | A1 | 11/2006 | Manning et al. |
| 2006/0259361 | A1 | 11/2006 | Barhydt et al. |
| 2006/0259418 | A1 | 11/2006 | Feaver |
| 2006/0259957 | A1 | 11/2006 | Tam et al. |
| 2006/0270478 | A1 | 11/2006 | Barhydt et al. |
| 2006/0277053 | A1 | 12/2006 | Lobb et al. |
| 2006/0287041 | A1 | 12/2006 | Walker et al. |
| 2006/0287924 | A1 | 12/2006 | Admon |
| 2006/0293994 | A1 | 12/2006 | Stuart |
| 2007/0004509 | A1 | 1/2007 | Banton |
| 2007/0004517 | A1 | 1/2007 | Mahajan |
| 2007/0004519 | A1 | 1/2007 | Swart et al. |
| 2007/0010314 | A1 | 1/2007 | Tulley et al. |
| 2007/0021168 | A1 | 1/2007 | Chamizer et al. |
| 2007/0021176 | A1 | 1/2007 | Jackson |
| 2007/0026928 | A1 | 2/2007 | Tulley et al. |
| 2007/0026929 | A1 | 2/2007 | Tulley et al. |
| 2007/0032301 | A1 | 2/2007 | Acres |
| 2007/0050281 | A1 | 3/2007 | Hoffman |
| 2007/0054718 | A1 | 3/2007 | Del Prado |
| 2007/0055606 | A1 | 3/2007 | Ausubel et al. |
| 2007/0060276 | A1 | 3/2007 | Monahan |
| 2007/0060380 | A1 | 3/2007 | Mcmonigle et al. |
| 2007/0063433 | A1 | 3/2007 | Ross |
| 2007/0072678 | A1 | 3/2007 | Dagres |
| 2007/0077981 | A1 | 4/2007 | Hungate et al. |
| 2007/0077997 | A1 | 4/2007 | Johnson |
| 2007/0087816 | A1 | 4/2007 | Van Luchene |
| 2007/0087833 | A1 | 4/2007 | Feeney et al. |
| 2007/0087835 | A1 | 4/2007 | Van Luchene |
| 2007/0105612 | A1 | 5/2007 | Fotevski |
| 2007/0111789 | A1 | 5/2007 | Van Deursen et al. |
| 2007/0118432 | A1 | 5/2007 | Vazirani et al. |
| 2007/0129139 | A1 | 6/2007 | Nguyen et al. |
| 2007/0167208 | A1 | 7/2007 | Acres et al. |

FOREIGN PATENT DOCUMENTS

| | | |
|---|---|---|
| EP | 1175928 | 1/2002 |
| EP | 1234606 | 8/2002 |
| EP | 1288817 | 3/2003 |
| EP | 1306788 | 5/2003 |
| GB | 2 425 267 | 10/2006 |
| WO | WO 80/01356 | 7/1980 |
| WO | WO 99/12135 | 3/1999 |
| WO | WO 00/32286 | 6/2000 |
| WO | WO 00/50974 | 8/2000 |
| WO | WO 01/73590 | 10/2001 |
| WO | WO 02/05517 | 1/2002 |
| WO | WO 02/42981 | 5/2002 |
| WO | WO 02/44901 | 6/2002 |
| WO | WO 02/097582 | 12/2002 |
| WO | WO 03/026757 | 4/2003 |
| WO | WO 03/032217 | 4/2003 |
| WO | WO 03/049054 | 6/2003 |
| WO | WO 03/083797 | 10/2003 |
| WO | WO 2005/015826 | 2/2005 |
| WO | WO 2005/075037 | 8/2005 |

OTHER PUBLICATIONS

"Auction," [online] [printed on Apr. 27, 2007]. Retrieved from the Internet at <URL: http://en.wikipedia.org/wiki/Auction>.

Bally Slot Machines Electro-Mechanicals 1964-1980 Book [In Part], Revised 3rd Edition written by Marshall Fey.

Winning Bid™ Brochure, written by WMS Gaming, Inc., available prior to Nov. 1, 2006.

* cited by examiner

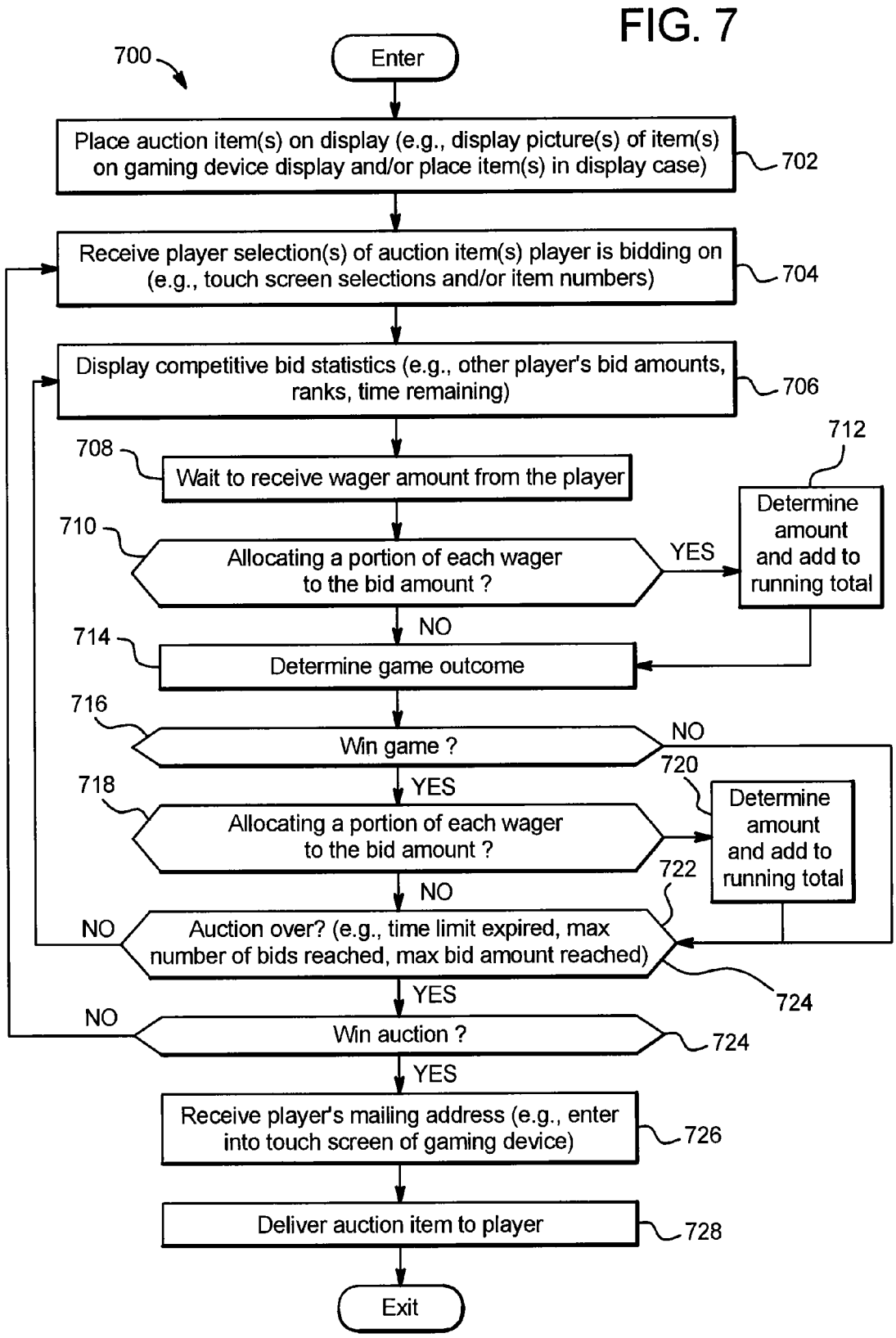
FIG. 7
700
Enter
Place auction item(s) on display (e.g., display picture(s) of item(s) on gaming device display and/or place item(s) in display case)
702
Receive player selection(s) of auction item(s) player is bidding on (e.g., touch screen selections and/or item numbers)
704
Display competitive bid statistics (e.g., other player's bid amounts, ranks, time remaining)
706
708
Wait to receive wager amount from the player
710
Allocating a portion of each wager to the bid amount ?
YES
712
Determine amount and add to running total
NO
714
Determine game outcome
716
Win game ?
NO
YES
718
Allocating a portion of each wager to the bid amount ?
720
Determine amount and add to running total
722
NO
NO
Auction over? (e.g., time limit expired, max number of bids reached, max bid amount reached)
724
YES
NO
Win auction ?
724
YES
Receive player's mailing address (e.g., enter into touch screen of gaming device)
726
Deliver auction item to player
728
Exit

METHODS AND APPARATUS FOR AUCTIONING AN ITEM VIA A GAMING DEVICE

PRIORITY CLAIM

This application is a non-provisional of, claims the benefit of, and claims priority of U.S. Provisional Patent Application, Ser. No. 60/705,341, filed on Aug. 4, 2005, entitled "Methods And Apparatus For Auctioning An Item Via A Gaming Device," the entire contents of which are incorporated herein.

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

TECHNICAL FIELD

The present application relates in general to gaming devices, and, in particular, to methods and apparatus for auctioning an item via a gaming device.

BACKGROUND

Gaming device manufacturers are always looking for new and exciting ways to reward players and make gaming device play more entertaining. Awarding players with physical prizes in lieu of the cash equivalent is one game enhancement that certain players enjoy. For example, a casino may offer a new car as a prize or award instead of a traditional cash jackpot. The car may be placed on display in the casino in close proximity to the gaming machines which are capable of enabling players of those gaming machines to win the car. This attracts attention to these gaming machines.

One problem with this type of jackpot incentive is that certain players quickly become discouraged by the fact that that they have tried many times and are no closer to winning the prize than when they started. In other words, the money the player has invested in or wagered on the gaming machine does not help the player's odds on subsequent plays of the gaming machine. Therefore, a large investment or a large wager amount is not an encouragement to continue playing the gaming machine and can be a discouragement.

In addition, because a casino may typically have only a few such gaming machines, players are given very little choice as to what prize they would like to pursue. It is therefore desirable to provide new and different gaming machines which enable players to win or obtain physical prizes instead of or in addition to monetary awards.

SUMMARY

The disclosed system provides methods and apparatus which enable a gaming device to facilitate the auctioning of a plurality of prizes, such as physical prizes. In one embodiment, the gaming device enables a player to select a prize the player would like to pursue from a plurality of different potential auction items or prizes. The gaming device enables the player to select the targeted item by activating an input device such as by pressing an area of a touch screen display associated with an image of an item, entering a prize identifying number into the gaming device, and/or in any other suitable manner. The gaming device thus enables the player to choose to pursue one or more physical prizes that are more in line with the player's personal preferences. In addition, by having a plurality of different physical prizes, the player may select lower value prizes which are generally more easy to obtain.

As the player plays the gaming device, in one embodiment the gaming device automatically attributes a portion of each wager and/or a portion of each award (cash or credits) won by the player to an accumulating bid on the selected auction item. This may encourage certain players to build on previous game play to increase the player's bid on the selected auction item. In certain embodiments, the gaming device enables the player to select the amount of each wager and/or award attributed to one or more auction bids. For example, the gaming device may enable the player to choose to bid 10% of each award the player wins on a selected auction item. In this example, the gaming device provides 90% of each award the player wins to the player and allocates 10% of each award the player wins on the selected auction item. In another example, the gaming device may enable the player to choose to bid 10% of each wager the player places at the gaming device. If the player is playing three lines of a dollar gaming device, then the gaming device applies $0.30 of each play to the player's auction bid(s). In such an instance, the gaming device enables the player to play each line of the gaming device for a decreased wager (e.g., $0.90 instead of $1.00). In one embodiment, the gaming device adjusts the paytable to account for the decreased wager(s).

In certain embodiments, the gaming device enables the player to change or switch the auction item that the player is bidding on during the auction. Since a plurality of auctions may operate simultaneously, the player may allocate the player's bid amount (or a portion thereof) to a different auction item. In one instance, the player stops bidding on a first auction item and starts bidding on a second auction item. Subsequent bid amounts may be attributed to the second auction item. In another instance, the player allocates the player's bid amount from a first auction item to a second auction item. The previously accumulated bid (or a portion thereof) may be attributed to the second auction item. For example, the player may initially be bidding on a relatively low cost auction item, such as cuff links, and then change to a relatively higher cost auction item, such as a watch. The auctions items may be chosen by the player, chosen by the gaming device or predetermined by the casino. The gaming device may offer the player a choice of whether to leave some or all of the previously accumulated bid on the original auction item and/or to move some or all of the previously accumulated bid to the new auction item.

In certain other embodiments, the gaming device sets the percentage, but the amount is not actually deducted from the player's credits. Instead, the auction item becomes a free prize for frequent players, which may be funded through a casino's marketing and/or advertising budget or department. Other casino budgets or departments may be used to fund the auction item. Additionally, third parties, such as prize manufacturers or distributors, may fund the auction item.

In one embodiment, the amount of each wager and/or award attributed to the accumulating bid is based on the duration of the player's play time. For example, during a first time period (e.g., 0 to 30 minutes) the gaming device may automatically attribute 1% of each wager and/or award to the accumulating bid; during a second time period (e.g., 30 to 60 minutes) the gaming device may automatically attribute 2% of each wager and/or award to the accumulating bid; and during a third time period (e.g., 60 to 120 minutes) the gaming device may automatically attribute 3% of each wager and/or award to the accumulating bid. Any suitable number of time periods may be used, and the duration of each time period need not be equal. In addition, the progression of wager percentages need not be linear. In the event that the casino is funding the bid, the amount of each wager and/or award attributed to the accumulating bid may be limited to a predetermined maximum (e.g., 5% after two hours of play). It should be appreciated, that in certain embodiments, the attribution is automatic after the player or operator sets this feature and this feature may be disabled.

In one embodiment, the amount of each wager and/or award attributed to the accumulating bid is based on the rate of the player's game play. For example, if the player is wagering at a rate that falls within a first range (e.g., from zero to five credits per minute), then the gaming device may automatically attribute 1% of each wager and/or award to the accumulating bid; if the player is wagering at a rate that falls within a second range (e.g., from five to ten credits per minute), then the gaming device may automatically attribute 2% of each wager and/or award to the accumulating bid; if the player is wagering at a rate that falls within a third range (e.g., from ten to twenty credits per minute), then the gaming device may automatically attribute 3% of each wager and/or award to the accumulating bid. Any suitable number of rate ranges may be used, and the size of each range need not be equal. In addition, the progression of wager percentages need not be linear. In the event that the casino is funding the bid through player incentives or monetary awards, the amount of each wager and/or award attributed to the accumulating bid may be limited to a predetermined maximum (e.g., 5% for wager rates above twenty credits per minute).

In certain embodiments, the casino matches a portion of the player's wager and/or award. The matched funds are applied to the accumulating bid. For example, a player may be given a 2-for-1 coupon that temporarily doubles the amount of each wager and/or award attributed to the accumulating bid (e.g., 2% instead of 1%). The coupon may be a physical coupon that may be inserted into the gaming device, a physical coupon with a unique identification code to be entered into the gaming device, and/or an electronic coupon. The coupon may be awarded to the player in any suitable manner. For example, the coupon may be awarded via the gaming device as part of a bonus game or presented to the player via the gaming device based on the player's identity or status as determined from a frequent player card or a player tracking system. In one embodiment, the matching is performed during a certain promotional time period, for certain promotional gaming devices and/or for certain players. In certain other embodiment, the matched funds are limited to or set within a predetermined minimum (e.g., 1% of each wager and/or award or $0.01) and/or a predetermined maximum (e.g., 5% of each wager and/or award or $0.05).

In certain other embodiments, the player's bid amount is funded by the player, the casino, a third party or some combination thereof. In one example, the bid amount includes 1% of each wager and/or award funded by the player, 2% of each wager and/or award funded by the casino (e.g., through matching or funded through a casino's marketing and/or advertising budget or department) and 2% of each wager and/or award funded by a third party. In such an instance, the player's bid amount totals 5% of each wager and/or award for an auction item, but only a portion of this bid amount (e.g., 1% of each wager and/or award) is funded by the player. The percentages may be set within a predetermined minimum (e.g., 1%) and/or a predetermined maximum (e.g., 10%) by the player, by the casino and/or by the third party.

In certain embodiments, the gaming device displays the current status of one or more selected auction items to the player. For example, a status box on the main display or a secondary display of the gaming device may inform the player of the selected auction item's name (e.g., Men's Watch), the highest bid on the selected auction item (e.g., $155), the player's current bid on the selected auction item (e.g., $140), and the time remaining in the auction for the selected auction item (e.g., 15 minutes).

In addition, the gaming device may enable the player to set a maximum amount the player is willing to bid on an auction item to prevent too much money to be bid on the item (such as a large win or a jackpot win from placing a large bid on the auction item). When a maximum amount is bid on an auction item, the gaming device may enable the player to bid on a different auction item. Similarly, the casino may set a minimum bid amount for an auction item to protect the casino from awarding a valuable auction item at far below the value of the auction item. For example, a player's auction bid must meet or exceed the predetermined minimum bid amount for the player's auction bid to be valid. Auction bids that do not meet the predetermined minimum bid amount may be returned to the player or may be stored and accumulated until the player's auction bid meets or exceeds the predetermined minimum bid amount.

Additionally, the casino may set a maximum bid amount for an auction item to prevent overbidding. When a maximum bid amount is reached, the gaming device may stop attributing a portion of the player's wagers and/or awards to the auction item. Alternatively, subsequent bid amounts and/or the previously accumulated bid may be attributed to a different auction item. For example, the player may initially be bidding on a relatively low cost auction item, such as a keychain, and then progress to a relatively higher cost auction item, such as a watch. The auctions items in the progression may be chosen by the player, chosen by the gaming device or predetermined by the casino. The gaming device may offer the player a choice of whether to leave some or all of the previously accumulated bid on the original auction item and/or to move some or all of the previously accumulated bid to the new auction item.

In certain embodiments, an auction ends (1) at a predetermined time; (2) after a predetermined length of time; (3) after a predetermined number of bids are received by one or more gaming devices associated with an auction, an auction item and/or an auction server; (4) after a maximum bid amount is placed on an auction item; and (5) after an acceptable bid amount is placed on an auction item. As described above, the gaming device displays information or statistics associated with one or more auctions and/or one or more auction items. The gaming device may display the information or statistics on one screen simultaneously or on different screens in succession. Such information may include the time remaining in the auction, the player's current bid amount, the current high bid amount, and if the auction has ended, the winning bid amount. In one embodiment, the gaming device generates an audio/visual output to notify the player that one or more auctions will end or is expected to end within a predetermined period of time, such as five minutes. In certain embodiments, the player, the casino and/or the game manufacturer sets the predetermined period of time. The audio/visual output may be in any suitable form, such as audio, text and/or video sent to, displayed by or played on the display device of the gaming device or other suitable display device or signage in the area of the gaming device.

In this manner, a player can quickly assess the player's chances of being the high bidder on an auction item given the player's current position and pace. The player may use this information to modify one or more gaming parameters to improve the player's likelihood of winning one of the auction items. For example, if the player is close to being the high bidder, the player may choose to continue playing the gaming device to attribute additional funds towards the player's bid. If the player is far away from being the high bidder or if little time remains in the auction, the player may choose to wager at a higher denomination (e.g., $1.00 slots instead of $0.25 slots), the player may choose to wager at a higher rate of play (e.g., $1.00 per play instead of $0.50 per play) and/or the player may choose to allocate a larger portion of each wager/win to the bid (e.g., 10% of each wager or win instead of 5%) in the various embodiments described herein. Alternatively, if the player is not the high bidder or if little time remains in the auction, the player may choose to supplement their bid amount with game credits, cash, tokens and/or points associated with a player tracking system.

If at the end of the auction, a player is the highest bidder on an auction item, the system provides the player the auction item. This can be done in any suitable manner. For example, the gaming device may print a receipt for the player, which the player can take to a prize redemption window. In another embodiment, the prize is physically sent to an address associated with or designated by the player. For example, the player's address may be entered into the gaming device or automatically retrieved from a database based on the player's frequent player account. Alternatively, the gaming device may provide a physical prize to a player if that player is the highest bidder.

In one embodiment, the gaming device enables a plurality of players to win an auction item for the same auction. For example, if two players are the highest bidders, the system provides the auction item to the two players. The two players may tie for the highest bid by having the same bid amount (e.g., $20.00). Alternatively, the two players may have different bid amounts (e.g., $20.00 and $19.75), which are higher than other players' bid amounts. In one embodiment, the auction is provided as a "Dutch" auction in which a plurality of identical auction items are auctioned simultaneously to an equal number of high bidders. The high bidders may or may not bid the same amounts to win an auction item.

If a player is not the highest bidder on an auction item, the player's bid amount may be returned to the player, or the player's bid amount may go to the casino. If the player's bid amount is returned to the player, the bid amount may be retuned in the form of game credits, cash, tokens, points associated with a player tracking system and/or goods or services provided by the casino or a third party, such as an auction item manufacturer or distributor. Alternatively, the gaming device may enable the player to employ the unused bid for another auction item.

Additional features and advantages of the present invention are described in, and will be apparent from, the following Detailed Description of the Invention and the figures.

BRIEF DESCRIPTION OF THE DRAWINGS

FIG. 7 is a flowchart of an example process for auctioning an item via a gaming device according to one embodiment of the methods and apparatus of the present system.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
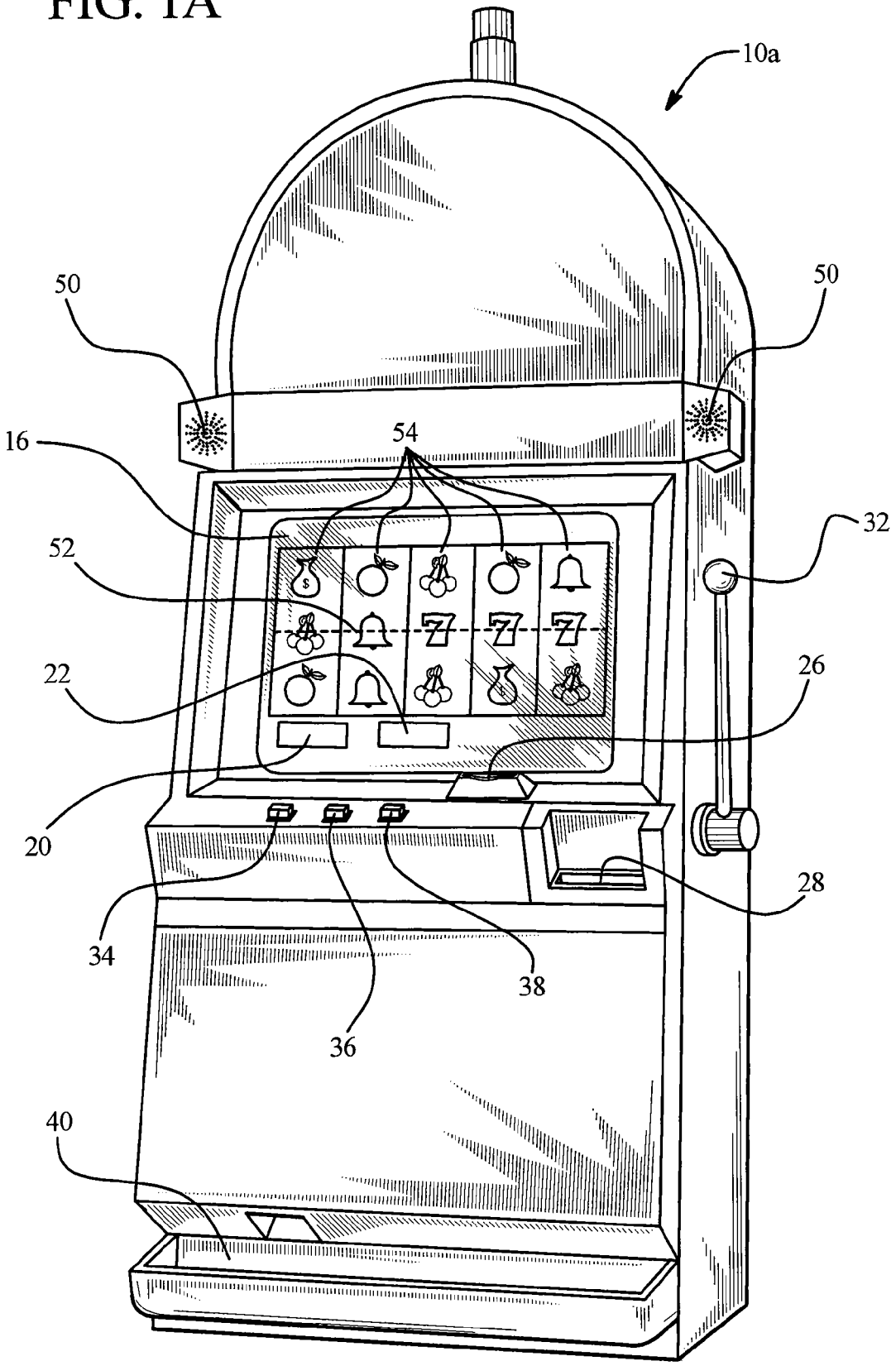
FIG. 1A is a perspective view of an example gaming device according to one embodiment of the methods and apparatus of the present system.
Figure 1B:
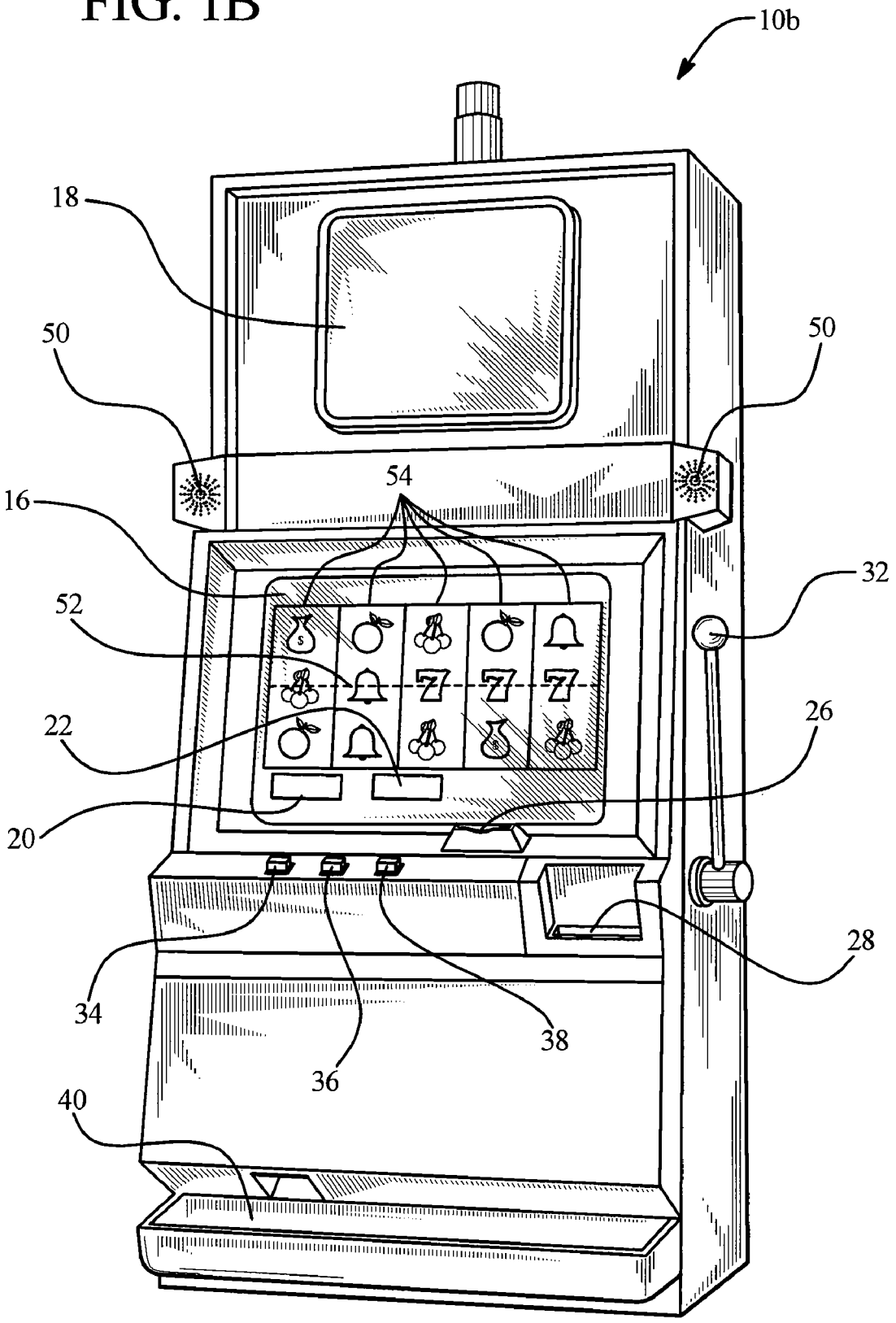
FIG. 1B is a perspective view of another example gaming device according to one embodiment of the methods and apparatus of the present system.

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
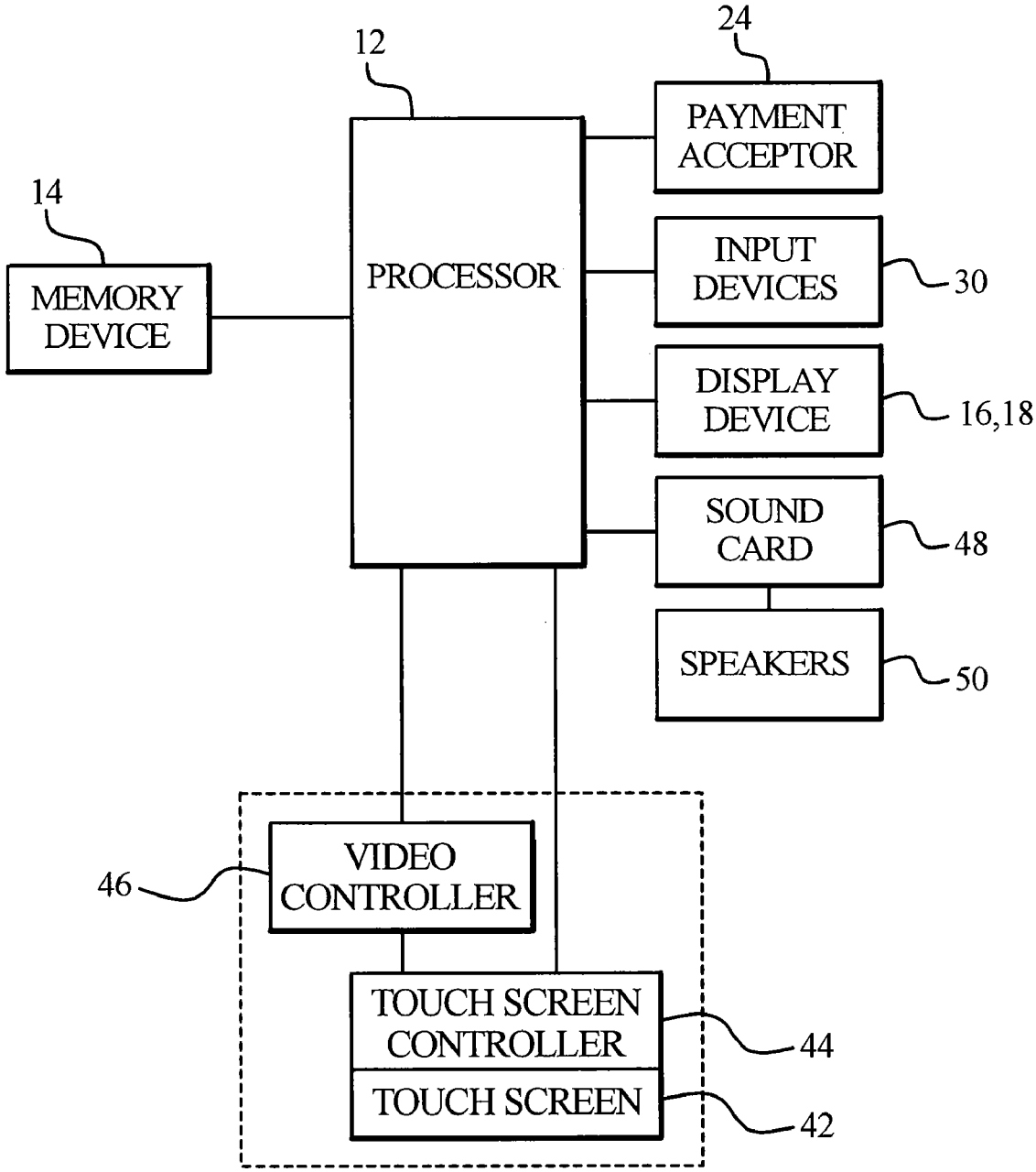
FIG. 2A is a schematic block diagram of an example electronic configuration of one embodiment of the methods and apparatus of the present system.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission.

The processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier (or other suitable redemption system) or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a touch-screen button panel. It should be appreciated that the utilization of touch-screens is widespread in the gaming industry.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
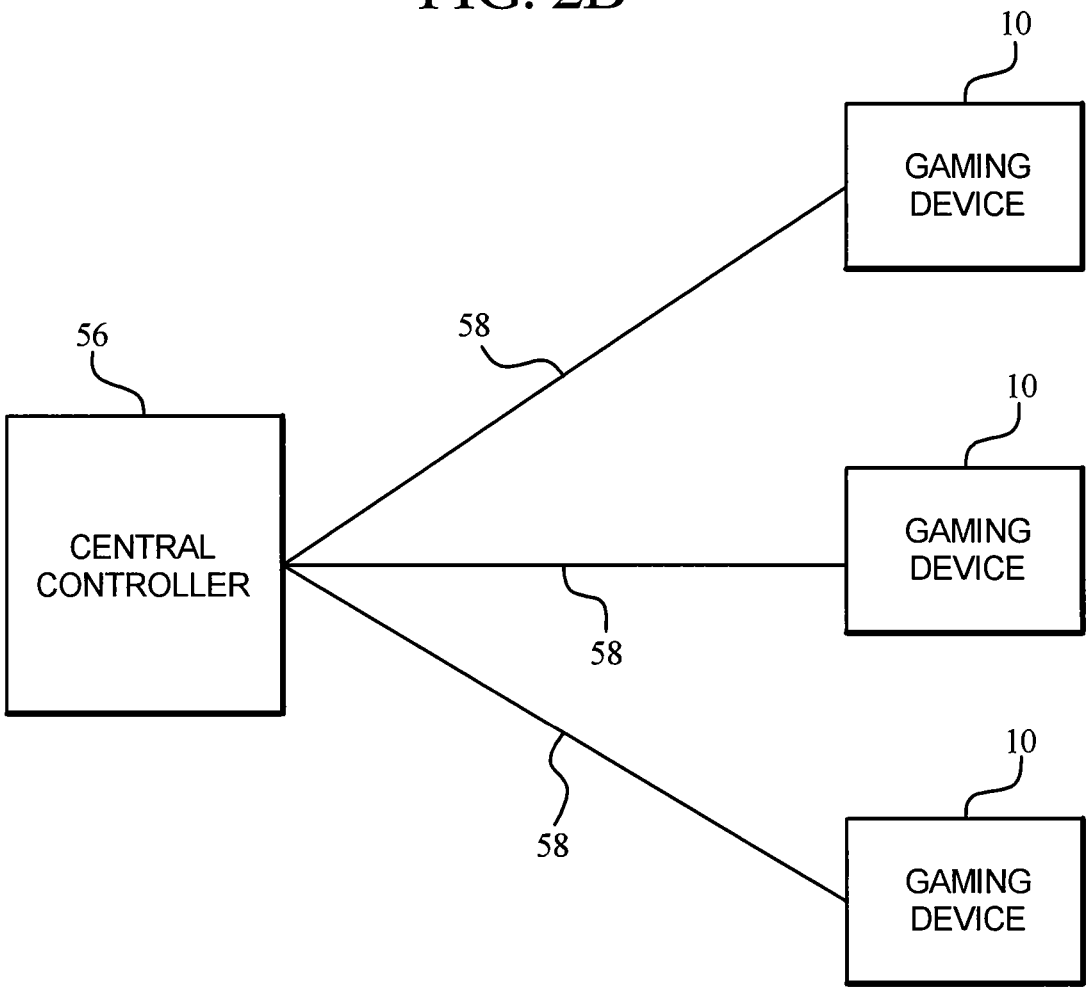
FIG. 2B is a schematic block diagram of one example communications network according to one embodiment of the methods and apparatus of the present system.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo or keno game. In this embodiment, each individual gaming device utilizes one or more bingo or keno games to determine the predetermined game outcome value provided to the player for the interactive game played at that gaming device. In one embodiment, the bingo or keno game is displayed to the player. In another embodiment, the bingo or keno game is not displayed to the player, but the results of the bingo or keno game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card.

Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment insures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. In this embodiment, the gaming device and/or player tracking system tracks any players gaming activity at the gaming device. In one such embodiment, the gaming device and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system hot site computer) determines when a progressive award win is triggered. In another embodiment, an individual gaming machine and a central controller (or progressive gaming system hot site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Item Auction

Figure 3:
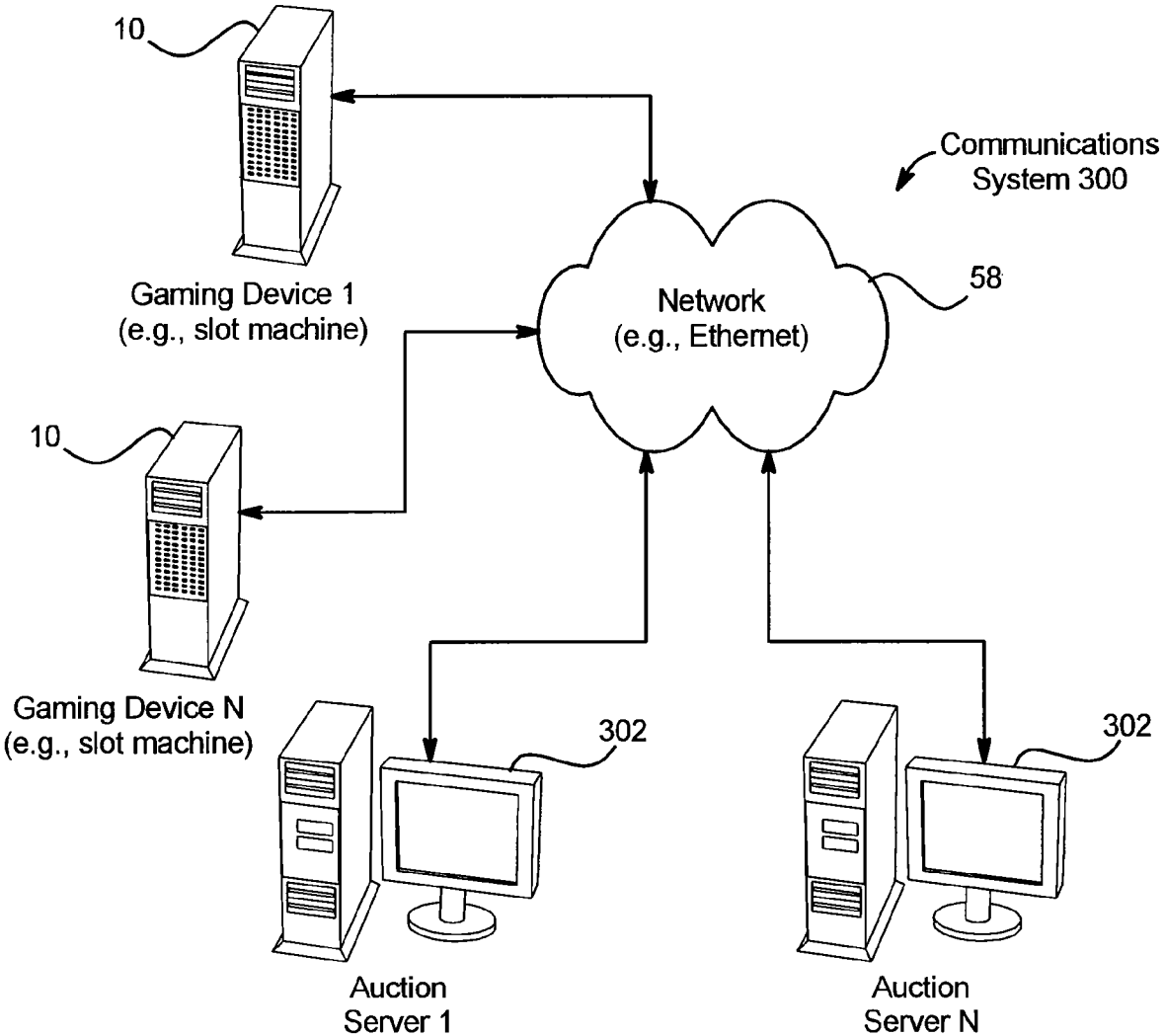
FIG. 3 is a block diagram of another example communications network connecting a plurality of gaming devices to at least one auction server according to one embodiment of the methods and apparatus of the present system.

A high level block diagram of an exemplary network communications system 300 is illustrated in FIG. 3. The illustrated system 300 includes one or more auction servers 302 connected via a network 58 to one or more gaming devices 10. An auction server 302 stores a plurality of files and/or programs in one or more databases for use by the gaming devices 10. The databases may be part of the auction servers 302 and/or connected via the network 58. The network 58 may be any type of suitable local or wide area network, such as a secure Ethernet network, a fiber optic network, and/or a wireless network. One auction server 302 may interact with a large number of gaming devices 10 and act as a central server or controller in communication with those gaming devices 10. Accordingly, each auction server 302 is typically a high end computer with a large storage capacity, one or more fast microprocessors, and one or more high speed network connections. Conversely, relative to an auction server 302, each gaming device 10 typically includes less storage capacity and computing power.

Preferably the auction related features of the gaming device 10 are integrated with the gaming device software and/or hardware. Alternatively, an auction console device may be peripheral to the gaming device 10. For example, the auction console device may be attached to the gaming device 10, located inside the gaming device 10, stationed next to the gaming device 10, and/or located near the gaming device 10.

For this disclosure, it should be appreciated that the auction related features may be provided independent and separate from game play on the gaming device 10 and/or may be integrated with game play on the gaming device 10. For example, the auction related features may be provided on certain gaming devices, to certain players, at certain times (such as after a suitable triggering event) or some combination thereof. Additionally, the auction related features may be funded by the player, the gaming establishment (e.g., a casino) and/or by a third party (such as a manufacturer or distributor of an auction item) in the form of game credits, cash, tokens, points associated with a player tracking system or any other suitable medium.

Figure 4:
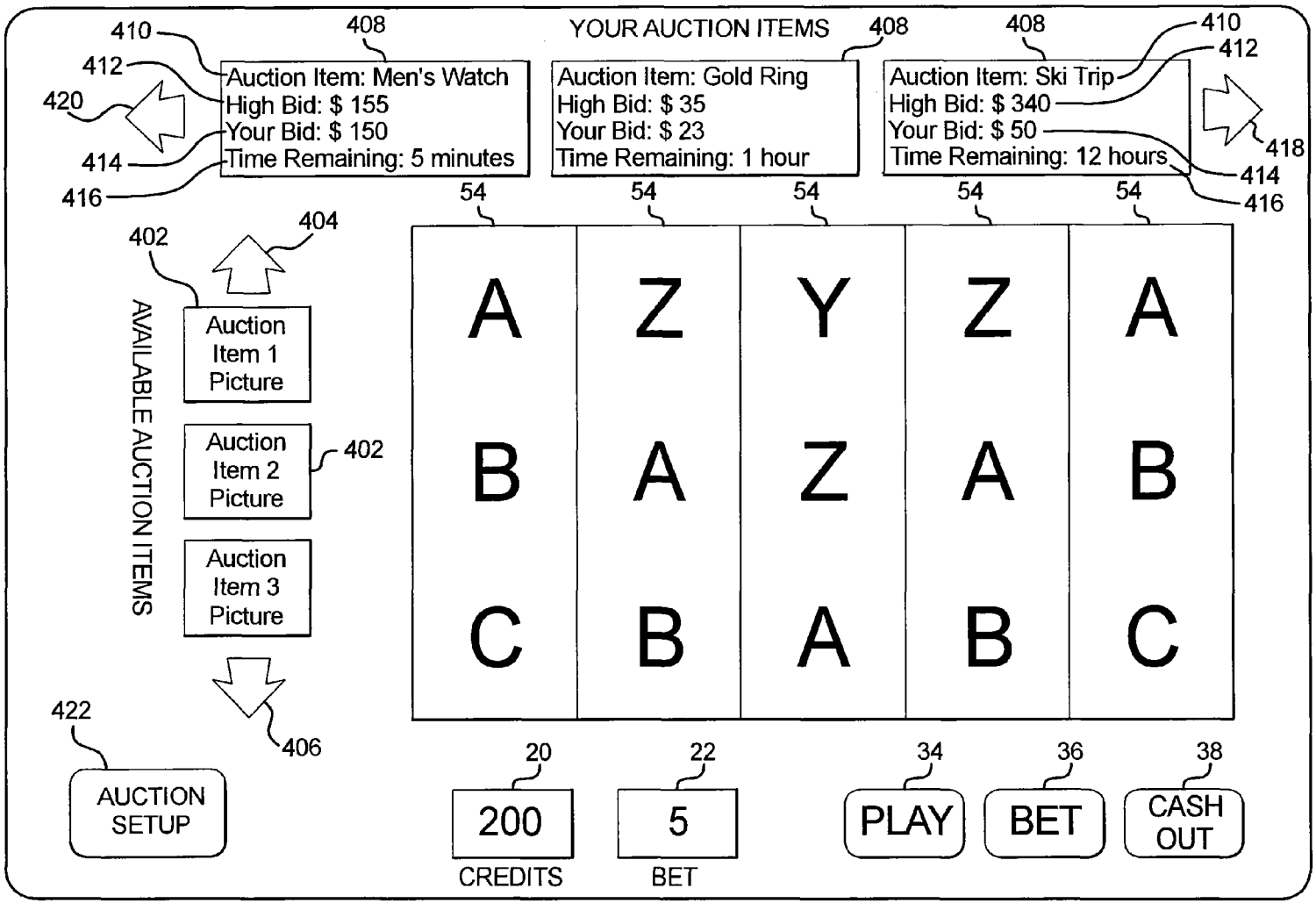
FIG. 4 is an illustration of an example screenshot of a gaming device with a plurality of onscreen auction features according to one embodiment of the methods and apparatus of the present system.

An illustration of an example screenshot of a gaming device 10 with a plurality of onscreen auction features is illustrated in FIG. 4. In this example, the gaming device 10 enables a player to scroll through a plurality of pictures 402, representing a plurality of auction items, by pressing an up arrow 404 or a down arrow 406 via the touch screen 42. When the player sees an auction item the player is interested in obtaining additional information on and/or bidding on, the gaming device 10 enables the player to select the auction item by pressing the area of the picture 402 of the auction item via the touch screen 42. It should be appreciated that any suitable method of viewing and/or selecting auction items may be used. For example, the player may view the actual auction items (e.g., in a display case) and the gaming device may enable the player to enter a number or other identifying characteristic associated with an actual auction item into the gaming device 10.

After the player selects one or more auction items, a status box 408 associated with each of the selected auction items may be displayed in another area of the screen. In this example, each status box 408 informs the player of the selected auction item's name 410 (e.g., Men's Watch), the highest bid on the selected auction item 412 (e.g., $155), the player's current bid 414 on the selected auction item (e.g., $150), and the time remaining 416 in the auction for the selected auction item (e.g., 5 minutes). The gaming device 10 may enable the player to scroll through a plurality of status boxes 408, representing a plurality of selected auction items, by pressing a right arrow 418 or a left arrow 420 via the touch screen 42. In addition, the gaming device 10 may enable the player to see additional details associated with a selected auction item by pressing a status box 408 via the touch screen 42. When the gaming device receives a selection of the status box 408 from the player, the display 16 or 18 switches to another view, and/or a pop-up window with the additional details appears.

Figure 5:
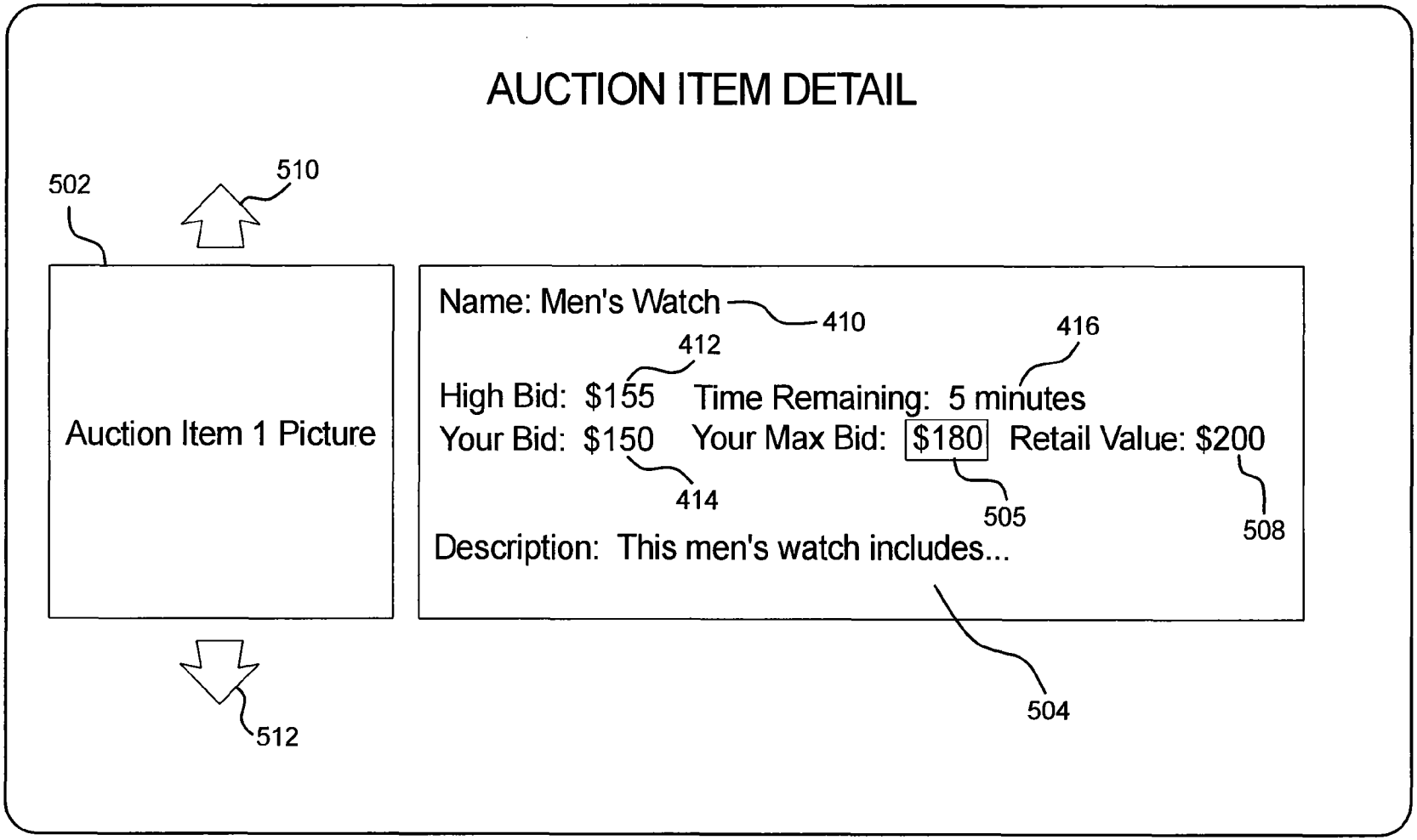
FIG. 5 is an illustration of an example screenshot of a gaming device showing a plurality of details associated with an auction item according to one embodiment of the methods and apparatus of the present system.

An illustration of an example screenshot showing additional details associated with a selected auction item is illustrated in FIG. 5. In this example, the gaming device 10 again shows the auction item's name 410 (e.g., Men's Watch), the highest bid on the auction item 412 (e.g., $155), the player's current bid on the auction item 414 (e.g., $150), and the time remaining in the auction for the selected auction item 416 (e.g., 5 minutes). In addition, the detailed view shows an enlarged picture 502 of the auction item, a detailed description 504 of the auction item, a player settable maximum bid 505 for the auction item, and a retail value 508 of the auction item. By displaying the detailed description 504, the enlarged picture 502, and the retail value 508, the gaming device 10 enables the player to make an informed decision as to the maximum bid 505 the player is willing to make for the selected auction item. In this manner, if the player is attributing a portion of each award won to the selected auction item, a large win (e.g., a jackpot) will not attribute an excessive amount to a bid on the auction item. In one embodiment, the gaming device 10 enables the player to scroll through a plurality of detailed views by pressing an up arrow 510 or a down arrow 512 via the touch screen 42. It should be appreciated that scroll bars, sliders or any other suitable graphical user interface symbols may be implemented in addition to, or in replacement of, the arrows 404, 406, 418, 420, 510 and 512 via touch screen 42 to enable the player to manipulate a plurality of displayed items or views.

Multiple auction items may be selected. As described in more detail below with reference to FIG. 7, bid amounts may be attributed to multiple auction items in series or in parallel. More specifically, if the player selects more than one auction item, the gaming device 10 may automatically attribute a portion of each wager and/or win to one of the selected auction items at a time (i.e., in series). Alternatively, the gaming device 10 may automatically attribute a portion of each wager and/or win to a separate bid on each auction item simultaneously (i.e., in parallel). The gaming device may also enable the player to select the percentages of attribution or contribution to each item if simultaneous, and the order of attribution if in series. The gaming device may also enable the player to select the percentage of a win attributable to an auction item. In the case of a portion of each wager being attributed to the items, the gaming system implementer, the casino and/or the player may control one, more or all of these parameters.

If an auction server 302 (or any other device, such as a central controller) determines that a player is the highest bidder on an auction item, the auction server 302 may or may not deduct the player's bid amount from the player's account. If the auction server 302 does not deduct the bid amount from the player's account, the auction item is essentially a "free" prize for frequent players (which may be based on player status as determined by a player tracking system). In either event, the highest bidding player is awarded the auction item. In one embodiment, the gaming device 10 prints a receipt for the player. The receipt includes a code. The receipt and code are configured to be accepted by a suitable ticket, voucher and receipt accepting device, such as the payment, note or bill acceptor 28 shown in FIG. 2A. When the player takes the receipt to a prize redemption window or position, an employee of the casino verifies the code via a suitable prize verification computer. If the ticket is associated with a winning bid, the prize is retrieved for the player. In an alternative embodiment, the gaming device 10 or another gaming device in the system verifies the code via a suitable prize verification process or module. For example, a player inserts the receipt into the gaming device for verification. In another embodiment, the prize is physically sent to the player. In such an instance, the player's delivery address or another address designated by the player is obtained. In one embodiment, the casino employee records the player's delivery or designated address. In another embodiment, the gaming device 10 records the player's delivery or designated address. The gaming device may prompt the player for the player's address when an auction is won, or the gaming device 10 may record the player's delivery or designated address via a player setup screen.

Figure 6:
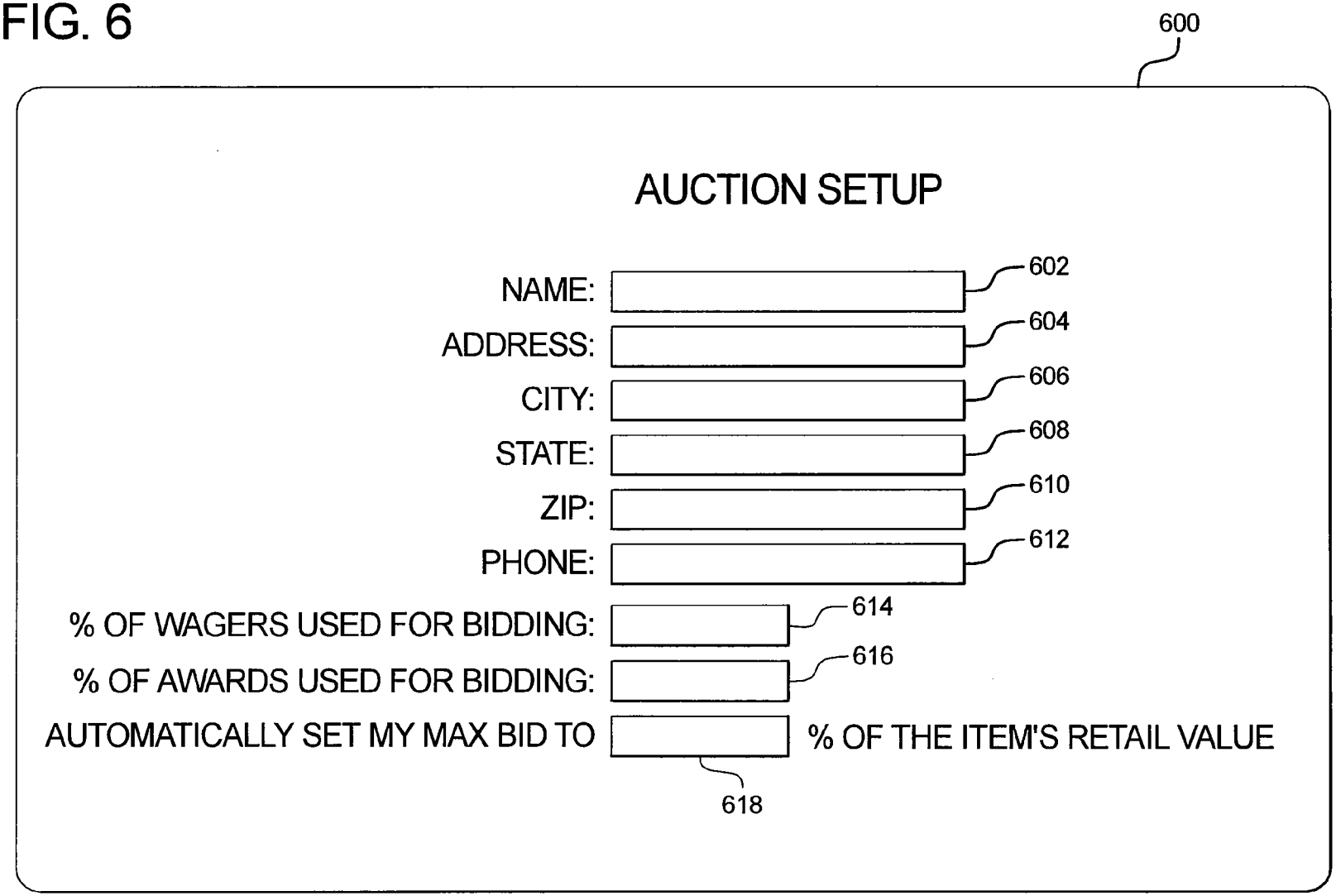
FIG. 6 is an illustration of an example player setup screen according to one embodiment of the methods and apparatus of the present system.

FIG. 6 is an illustration of an example player setup screen 600. Some or all of the player setup screen 600 may automatically prompt the player if the player wins an auction. In addition, the player setup screen 600 may be accessed via an auction setup button 422 on the main game display (see FIG. 4). In this example, the player setup screen 600 includes a name field 602, an address field 604, a city field 606, a state field 608, a zip code field 610, and a phone number field 612. One or more of these fields may be completed by the player to facilitate delivery of an auction item. The gaming device 10 may enable the player to complete these fields via a keypad 102, the touch screen 42, by inserting a frequent player card in the card reader 115, and/or any other suitable manner.

In addition, the example player setup screen 600 includes a "% of wagers used for bidding" field 614, a "% of awards used for bidding" field 616, and an "automatically set my max bid" field 618. In this embodiment, the "% of wagers used for bidding" field 614 enables the player to set what percentage of each wager made by the player is applied to the player's auction bid(s). For example, if the player selects 0%, no amount of each wager is applied to the player's auction bid(s). If the player selects 10%, and the player is playing three lines of a dollar slot machine, then the gaming device 10 applies $0.30 of each play to the player's auction bid(s). In such an instance, the pay table associated with the gaming device 10 may be adjusted to account for the decreased wagers (e.g., $0.90 per line instead of one dollar per line).

However, in certain embodiments, losing auction bids are forfeited to a gaming establishment such as a casino (as opposed to returned to the player). In such an instance, the pay table may not be adjusted. In one embodiment, losing auction bids (or a portion thereof) funded from a wager placed by a player are forfeited to a gaming establishment. In another embodiment, losing auction bids (or a portion thereof) funded from a wager placed by a player are returned to the player. In such an instance, portions of losing auction bids are returned to the player as game credits, cash, tokens, points associated with a player tracking system. In one embodiment, the bid amount is returned in the form of a consolation prize, such as a t-shirt or other goods and/or services provided by the gaming establishment.

Alternatively, portions of losing auction bids are forfeited to the gaming establishment and/or portions of losing auction bids are returned to the player. For example, a predetermined portion of losing auction bids, such as 0%, 10% or 100%, are forfeited to the gaming establishment and/or a predetermined portion of losing auction bids, such as 0%, 10% or 100%, are returned to the player. In certain embodiments, the losing auction bids (or portions thereof) are returned to the player as game credits, cash, tokens, points associated with a player tracking system and/or other goods and/or services provided by the gaming establishment (e.g., such as t-shirts).

Alternatively, the percentage of wagers used for bidding may be set by the game manufacturer and/or a casino. For example, the gaming device 10 may automatically attribute 1% of each wager to a bid amount. In one embodiment, the gaming device 10 does not deduct this amount from the player's wager. For example, if the player is playing three lines of a dollar slot machine, then the gaming device 10 applies $0.03 of each play to the player's auction bid(s). In such an instance, the pay table associated with the gaming device 10 may be set to account for the 1%.

The "% of awards used for bidding" field 616 enables the player to set what percentage of each award won by the player is applied to the player's auction bid(s). For example, if the player selects 0%, no amount of each award is applied to the player's auction bid(s). If the player selects 10%, and the player wins $100, then $10 is applied to the player's auction bid(s). In one embodiment, the percentage is capped or limited to a predetermined value, such as 10% or 50%. In another embodiment, the percentage is uncapped or unlimited and may constitute 100% or more of each award won by the player or each wager placed by the player. The percentages of awards or winning outcomes used for bidding may be limited to predetermined minimum and maximum percentages determined by the player, the casino, the game implementer, the game manufacturer or some combination thereof.

In certain embodiments, the gaming device enables a player to place bids on an auction item or to supplement existing or running bids on an auction item with game credits, cash, tokens and/or points associated with a player tracking system. Such game credits, cash, tokens and/or points may be input into the gaming device, displayed on a credit meter or retrieved from a player tracking account (e.g., a frequent player card) associated with the player. For example, if an auction for an auction item ends in five minutes, the player has limited time in which to increase the player's bid amount to win the auction. The remaining time in an auction may be displayed to the player and the gaming device may notify the player through suitable audio/visual output that an auction will end or is expected to end within a predetermined time period (e.g., the auction will end in five minutes) or after a number of additional bids (e.g., the auction will end after five more bids). The player may not have enough time to modify the game parameters (e.g., to make a number of wagers or to increase the wager amounts) to increase the player's bid amount to a desired level before the auction ends. In such an instance, the gaming device may enable the player to supplement the player's existing or running bid amount on an auction item in an attempt to win the auction. For example, the player may insert $20 into the gaming device or transfer 20 credits from the credit meter to supplement the player's existing or running bid amount on the auction item.

Alternatively, the gaming device enables the player to place or initiate a bid on an auction item with game credits, cash, tokens and/or points. In such an instance, the player's bid amount may be independent of game play on the gaming device. In these instances, if the player's bid does not win the auction item, the losing bid or a portion of the losing bid may be forfeited to the casino or gaming establishment, returned to the player or some combination thereof. In one embodiment, losing bids (or portions thereof) that were funded via wagers made by the player are forfeited to the casino or gaming establishment and losing bids (or portions thereof) that were funded via awards won by the player are returned to the player. Losing bids (or portions thereof) that were funded via awards won by the player are returned to the player in the form of game credits, cash, tokens, points associated with a player tracking system and/or prizes (e.g., a t-shirt or other goods and/or services).

For example, if a player plays one line of a dollar gaming device and attributes 0% of the wager to the player's auction bid(s), then the gaming device applies $0.00 of each play to the player's auction bid(s). In such an instance, the gaming device enables the player to play the line of the gaming device for $1.00. However, if the player plays one line of a dollar gaming device and attributes 10% of the wager to the player's auction bid(s), then the gaming device applies $0.10 of each play to the player's auction bid(s). In such an instance, the gaming device enables the player to play the line of the gaming device for a decreased wager (e.g., $0.90 instead of $1.00). In one embodiment, the gaming device adjusts the paytable to account for the decreased wager. If the player loses the auction associated with the player's auction bid, the losing auction bid (or a portion thereof) funded via the player's wager(s) may be forfeited to the gaming establishment and/or returned to the player. If the player plays one line of a dollar gaming device and attributes 0% of the award to the player's auction bid(s), then the gaming device applies $0.00 of an award to the player's auction bid(s). In such an instance, the gaming device enables the player to play the line of the gaming device for $1.00 and provides 100% of any award won during the play to the player.

However, if the player plays one line of a dollar gaming device and attributes 10% of an award to the player's auction bid(s), then the gaming device applies $0.10 of each award to the player's auction bid(s). In such an instance, the gaming device provides the player with a decreased award (e.g., based on $0.90 instead of $1.00) if the player wins an award during the play. If the player loses the auction associated with the player's auction bid, the losing auction bid (or a portion thereof) funded via the player's award(s) may be forfeited to the gaming establishment and/or returned to the player. Losing auction bids (or portions thereof) that were funded via awards won by the player are returned to the player in the form of game credits, cash, tokens, points associated with a player tracking system and/or prizes (e.g., a t-shirt or other goods and/or services). In one embodiment, the player may use the losing auction bids (or portions thereof) on a different auction item.

In one embodiment, the player plays one line of a dollar gaming device. If the player attributes 10% of the wager to the player's auction bid(s) and attributes 10% of an award to the player's auction bid(s), then the gaming device applies $0.10 of each play to the player's auction bid(s) and applies $0.10 of each award to the player's auction bid(s). In such an instance, the gaming. device enables the player to play the line of the gaming device for a decreased wager (e.g., $0.90 instead of $1.00) and provides the player with a decreased award (e.g., based on $0.90 instead of $1.00) if the player wins an award during the play. In such an instance, if the player wins the award (e.g., $0.90), the player's bid amount is increased by $0.20 (e.g., $0.10 from the wager and $0.10 from the award). If the player loses the auction associated with the player's auction bid, the losing auction bid (or a portion thereof) funded via the player's wager(s) may be forfeited to the gaming establishment and the losing auction bid (or a portion thereof) funded via the player's award(s) may be returned to the player. Alternatively, the losing auction bids (or a portion thereof) may be forfeited to the gaming establishment and/or returned to the player independently of how the losing auction bids (or a portion thereof) were funded. In one embodiment, only the losing auction bids (or a portion thereof) funded via the player's wager(s) are forfeited to the gaming establishment and other losing auction bids (or a portion thereof) are returned to the player. In one embodiment, the player may use the losing auction bids (or portions thereof) on a different auction item.

To prevent a large award (e.g., a jackpot) from causing an excessive bid amount on an auction item, the gaming device 10 may enable the player to set a maximum bid and/or the casino may establish a maximum bid amount for each auction item. As previously described with reference to FIG. 5, the gaming device 10 may enable the player to set the maximum bid separately for each auction item. Alternatively, the gaming device 10 may enable the player to enter a percentage in the "automatically set my max bid" field 618 of the setup screen 600. The percentage entered by the player is multiplied by each auction item's retail value to set the maximum bid for each auction item. For example, if the player enters 90% into the "automatically set my max bid" field 618, and the player is bidding on a watch with a retail value of $200, then the maximum bid the gaming device 10 will apply to the watch is $180. Similarly, if the player enters 110% into the "automatically set my max bid" field 618, and the player is bidding on the watch with the retail value of $200, then the maximum bid the gaming device 10 will apply to the watch is $220. In this example, if the player chooses to bid 10% of each award on the watch, and the player wins a $10,000 jackpot, the total bid made on the watch is $220 (not $1,000). In one embodiment, the percentage in the "automatically set my max bid" field 618 overrides the percentage in the "% of wagers used for bidding" field 614 and/or the percentage in "% of awards used for bidding" field 616. In an alternative embodiment, the gaming device enables the player to confirm a bid amount for an auction item prior to placing the bid amount.

In certain embodiments, the percentage is set by the gaming device 10, but the amount is not actually deducted from the player's credits. Instead, the auction item becomes a "free" prize for frequent players (which may be based on player status as determined by a player tracking system). For example, the gaming device enables a frequent player to use points associated with a player tracking system to bid on one or more auction items. In this instance, instead of deducting the bid amount from the player's credits, the bid amount is deducted from points associated with a player tracking system, such as a player's frequent player card or a player tracking account. In certain other embodiments, the gaming device 10 enables the player to accumulate a plurality of bonus awards associated with a predetermined symbol or symbol combination and/or a bonus game. In such an instance, the gaming device 10 enables the player to bid on the auction item using the accumulated bonus awards (or a portion thereof).

A flowchart of an example process 700 for auctioning an item via a gaming device 10 is illustrated in FIG. 7. In one embodiment, the process 700 is embodied in one or more software programs which is stored in one or more memories and executed by one or more processors. Although the process 700 is described with reference to the flowchart illustrated in FIG. 7, it should be appreciated that many other methods of performing the acts associated with process 700 may be used. For example, the order of many of the blocks may be changed, and many of the blocks described may be optional.

Generally, the process 700 enables a gaming device player (e.g., a slot machine player) to select one or more auction items the player is interested in bidding on. The auction items may be auctioned simultaneously or sequentially. As the player plays the gaming device, a predetermined, randomly determined or other suitably determined portion of each bet and/or a predetermined, randomly determined or other suitably determined portion of each win is allocated to an accumulating bid on the selected auction item(s). In one embodiment, the allocation is automatic. Other players, connected via a network, also bid on the auction item(s) in a similar fashion. At the end of an auction, the highest bidder" (e.g., the player(s) who accumulated the highest bid) is awarded with the auction item.

The process 700 begins by placing one or more auction items on display as indicated by block 702. For example, an image 402, 502 of an auction item may be transmitted from an auction server 302 to each of the gaming devices 10 for display on the gaming device touch screen 42. Alternatively, or in addition, auction items may be physically displayed (e.g., in a glass display case) or displayed to the player(s) in any suitable manner. In such an instance, the gaming device may be configured to distribute a physical auction prize to a player if that player is the highest bidder on the physical auction prize.

In one embodiment, only a single auction item is up for bid at a time. In such an instance, the gaming device 10 may give the player an option to participate in the bidding process. In one embodiment, if the player chooses not to participate in the bidding process, the gaming device 10 operates in a normal fashion (i.e., without automatically allocating a portion of each wager and/or win to a bid on the auction item). In such an instance, the gaming device 10 may enable the player to join the bidding at any time. For example, the gaming device 10 may enable the player to choose to participate in the bidding process when a new auction item is offered or during an ongoing or existing auction. In one embodiment, when a player joins an existing auction, the player's first contribution towards the player's bid is based on the player's next wager and/or win. In another embodiment, the gaming device 10 enables the player to participate in the bidding process of a new or an existing auction after the player allocates a portion of each wager and/or win to a bid on the auction item. In such an instance, the player's account is funded prior to the gaming device 10 enabling the player to participate in the bidding process.

If more than one item is up for auction, the gaming device 10 may enable the player to select which auction item(s) the player is interested in bidding on as indicated by block 704. For example, the touch screen 42 may display a plurality of images representing the auction items, and the gaming device 10 may enable the player to select one or more of the auction items by touching the images on the touch screen 42. Alternatively, or in addition, physically displayed auction items may be selected by entering a number or other identifying characteristic associated with the physically displayed auction item into the gaming device 10. These auction item number(s) or characteristic(s) may be entered into the gaming device by any means such as the keypad 102 and/or the touch screen 42.

The gaming device 10 then displays competitive statistics associated with the selected auction item(s) as indicated by block 706. For example, the gaming device 10 may display the current high bid 412 associated with each auction item, the current player's rank or bid 414, the time remaining 416 in the auction, etc. In this manner, a player can quickly assess the player's chances of being the high bidder on an auction item given the player's current position and pace. The player may use this information to modify one or more gaming parameters. For example, if the player is close to being the high bidder, the player may choose to continue playing the gaming device 10 to attribute additional funds towards the player's bid. If the player is far away from being the high bidder or if little time remains in the auction, the player may choose to wager at a higher denomination (e.g., $1.00 slots instead of $0.25 slots), the player may choose to wager at a higher rate of play (e.g., $1.00 per play instead of $0.50 per play) and/or the player may choose to allocate a larger portion of each wager/win to the bid (e.g., 10% of each wager or win instead of 5%) in the various embodiments described herein. Alternatively, if the player is not the high bidder or if little time remains in the auction, the player may choose to supplement their bid amount with game credits, cash, tokens and/or points associated with a player tracking system to increase the player's bid amount.

In one embodiment, each time the gaming device 10 receives a bet or wager from a player, the gaming device 10 allocates a predefined portion of that bet and/or a predefined portion of any award associated with that bet to the player's bid(s). Accordingly, the gaming device 10 waits for the player to select a wager amount as indicated by block 708. If the player is allocating a portion of each wager to a bid amount as indicated by block 710, the gaming device 10 determines the amount and adds it to a running or existing bid as indicated by block 712. In one embodiment, the gaming device 10 is preprogrammed with a percentage of each wager (or a flat or predetermined amount) that the gaming device 10 attributes to the running total for the bid (e.g., 1%). In another embodiment, the gaming device 10 enables the player to select a percentage (or a flat or predetermined amount) that the gaming device 10 attributes to the running total for the bid. For example, if 10% of each wager is to be attributed to an auction bid, and the player plays three lines on a $1.00 slot machine, then $0.30 is automatically allocated to the auction bid.

In one embodiment, the gaming device 10 automatically attributes a percentage of each wager to the running total for the bid based on the duration of game play (e.g., 1% for the first half hour of game play and 2% for the second half hour of game play). In one embodiment, the gaming device 10 automatically attributes a percentage of each wager to the running total for the bid based on the rate of game play (e.g., 1% for zero to five credits per minute and 2% for five to ten credits per minute).

In certain embodiments, the casino matches a portion of the player's wager and applies the matched funds to the accumulating bid (e.g., a 2-for-1 coupon or promotion). For example, a player may be given a 2-for-1 coupon that temporarily doubles the amount of each wager and/or award attributed to the accumulating bid (e.g., 2% instead of 1%). The coupon may be a physical coupon that may be inserted into the gaming device, a physical coupon with a unique identification code to be entered into the gaming device, and/or an electronic coupon. The coupon may be awarded to the player in any suitable manner. For example, the coupon may be awarded via the gaming device as part of a bonus game or presented to the player via the gaming device based on the player's identity or status as determined from a frequent player card. Similarly, the matching may be performed during a certain promotional time period, for certain promotional gaming machines and/or for certain players. In certain embodiments, the matched funds are limited to or set within a predetermined minimum (e.g., 1% of each wager and/or award or $0.01) and/or a predetermined maximum (e.g., 5% of each wager and/or award or $0.05).

In one embodiment, the percentage of each wager or the percentage of matched funds is based on player status (as determined through a player tracking system). For example, a player with a high status (e.g., platinum or gold) may be given a higher percentage than a player with low status (e.g., bronze or no status).

In one embodiment, some gaming devices 10 are programmed to allocate a portion of each wager amount, other gaming devices 10 are programmed to allocate a portion of each award amount, and some gaming devices 10 are programmed to allocate a portion of each wager amount and each award amount to one or more auction bids. The portions or percentages allocated to the auction bids may be limited to predetermined minimum or maximum percentages set by the player, the casino, the game implementer, the game manufacturer and/or any combination thereof.

After the player selects a wager amount and initiates game play, the gaming device 10 (and/or the auction server) determines the game outcome as indicated by block 714. If the player won an award as indicated by block 716, and the player is allocating a portion of each award to a bid amount as indicated by block 718, the gaming device 10 determines the amount and adds it to a running or existing bid as indicated by block 720. Again, the gaming device may be preprogrammed with a percentage of each award (or a flat or predetermined amount) that it attributes to the running total for the bid (e.g., 10%), or the gaming device 10 may enable the player to select a percentage (or a flat or predetermined amount) that is attributed to the running total for the bid. For example, if 10% of each award is to be attributed to an auction bid, and the player wins $1000, then $100 is automatically allocated to the auction bid.

In one embodiment, the gaming device 10 automatically attributes a percentage of each award to the running total for the bid based on the duration of game play (e.g., 1% for the first half hour of game play and 2% for the second half hour of game play). In one embodiment, the gaming device 10 automatically attributes a percentage of each award to the running total for the bid based on the rate of game play (e.g., 1% for zero to five credits per minute and 2% for five to ten credits per minute).

In certain embodiments, the casino matches a portion of the player's award and applies the matched funds to the accumulating bid (e.g., a 2-for-1 coupon or promotion). For example, a player may be given a 2-for-1 coupon that temporarily doubles the amount of each wager and/or award attributed to the accumulating bid (e.g., 2% instead of 1%). The coupon may be a physical coupon that may be inserted into the gaming device, a physical coupon with a unique identification code to be entered into the gaming device, and/or an electronic coupon. The coupon may be awarded to the player in any suitable manner as described above. Similarly, the matching may be performed during a certain promotional time period, for certain promotional gaming machines, and/or for certain players. In certain embodiments, the matched funds are limited to or set within a predetermined minimum (e.g., 1% of each wager and/or award or $0.01) and/or a predetermined maximum (e.g., 5% of each wager and/or award or $0.05).

In one embodiment, the percentage of each award or the percentage of matched funds is based on player status (as determined through a player tracking system). For example, a player with a high status (e.g., platinum or gold) may be given a higher percentage than a player with low status (e.g., bronze or no status).

If the player selects more than one auction item, the gaming device 10 may automatically attribute a portion of each wager and/or win to a separate bid on each auction item simultaneously. In one embodiment, the gaming device 10 divides the predefined amount or percentage equally between each of the selected auction items. In another embodiment, the gaming device 10 attributes amounts or percentages to each auction item based on player selections. For example, the gaming device 10 may enable the player to choose to allocate 10% of each award to two different auction items, where one of the auction items receives 75% of the 10% (i.e., 7.5% of the award), and the other auction item receives 25% of the 10% (i.e., 2.5% of the award). In an additional embodiment, the gaming device 10 attributes an amount or percentage to each auction item randomly or based on player status as determined through a player tracking system.

Alternatively, the gaming device 10 may automatically attribute a portion of each wager and/or win to one of the selected auction items at a time. For example, the player may select three auction items from ten available auction items. Then, the gaming device 10 may enable the player to decide to apply a portion of each wager and/or win to the first of the three selected auction items, then the second auction item, etc. The gaming device 10 may base the switch over point from one auction item to another auction item on a time limit associated with the auction item, a time limit selected by the player, a maximum bid amount associated with the auction item, a maximum bid amount selected by the player, a player determination, a random determination, a player selection or any other suitable event.

When a player is not the winning bidder on an auction item, the gaming device 10 may refund the losing bid amount (as cash and/or gaming credits or another suitable redemption format) to the player who made the losing bid, or the gaming device 10 may apply the losing bid amount to one or more alternate auction items (e.g., the next auction item in a series of selected auction items). In one embodiment, the gaming device 10 enables the player to select another auction item (e.g., from the series of selected auction items or from the series of non-selected auction items) to apply the losing bid amount.

During the auction, the gaming device, in operation with a display device, displays competitive statistics, pertaining to a status of the auction. The competitive statistics may include the time remaining in each auction, the number of bids associated with each auction item, the maximum bid amount associated with each auction item, the minimum bid amount associated with each auction item, the acceptable bid amount associated with each auction item and/or the current high bid associated with each auction item. The competitive statistics provide notice to the player of the status of one or more auction items and/or auctions. In one embodiment, the gaming device provides suitable audio/visual output to notify the player of the auction status, such as a message stating "the auction will end in 5 minutes" or "the auction will end after 5 more bids." In this manner, a player can quickly assess the player's chances of being the high bidder on an auction item given the player's current position and pace. The player may use this information to modify one or more gaming parameters. In one instance, the player may change the auction item on which the player is bidding or allocating portions of wagers and/or awards. In another instance, the player may choose to supplement the player's bid amount with game credits, cash, tokens and/or points associated with a player tracking system.

The above described process (block 704 to block 720) continues until an auction ends as indicated by block 722. For example, a predetermined time may mark the end of an auction (e.g., 2 PM). Alternatively, or in addition, a maximum number of bids being received by all of the gaming devices 10 associated with an auction, an auction item, and/or an auction server 302 may mark the end of an auction (e.g., 1000 bids). In another embodiment, an auction server 302 (or other device) uses the reception of a maximum bid amount to mark the end of an auction (e.g., $1000). Players'benefit from a maximum bid amount by not needing to concern themselves with bidding more than an auction item is worth, especially in embodiments where a percentage of an award is wagered. If a maximum bid amount is reached, the gaming device 10 may attribute subsequent bid amounts and/or some or all of the previously accumulated bid to a different auction item (e.g., a higher value auction item). In certain embodiments, a minimum bid amount is associated with an auction item to protect the casino from awarding a valuable auction item at far below the value of the auction item.

In an alternative embodiment, an acceptable bid amount, such as a predetermined amount or percentage of the value of an auction item, is associated with the auction item and the auction ends when the auction server 302 (or another device) receives a bid amount that meets or exceeds the acceptable bid amount. For example, the casino may associate an auction item having a value of $200 with an acceptable amount, such as $180 or any other suitable value or amount. The acceptable amount represents a value or amount that: (1) protects the casino from awarding an auction item below the value of the auction item and related handling cost and/or (2) enables the casino to profit from awarding the auction item. When a player's bid reaches or exceeds the acceptable amount of $180, the player wins or is awarded the auction item worth $200. It should be appreciated that the auction item may be awarded to the player immediately or prior to the end of the auction. If the auction item costs the casino $150, the casino profits $30 for awarding the auction item and the player receives a discount of $20 on the auction item. Players'benefit from an acceptable bid amount by being able to win an auction item immediately or prior to the end of the auction at a set or predetermined bid amount.

After an auction is completed, the gaming device 10 (or some other device) determines if the player won the auction as indicated by block 724. If the player won the auction, the process 700 optionally receives the player's delivery or other designated address as indicated by block 726. For example, the gaming device 10 may ask the player to enter the player's delivery or designated address via the touch screen 42. Alternatively, or in addition, the player's identity and/or delivery address may be known through the use of a player reward system such as a magnetic frequent players card that is inserted in and read by the gaming device 10.

If the player won the auction, the auction item is delivered to the player as indicated by block 728. If the auction item is available on the premises of the casino, the auction item may be delivered to the player at the casino. For example, an attendant may bring the auction item to the player at the gaming device 10 or deliver the auction item to the player's room if the player is a guest at the casino's hotel. Alternatively, the gaming device 10 may print a ticket that identifies the auction item award. In such an instance, the player may redeem the ticket for the auction item at a prize redemption window in the casino. If the auction item is not available on the premises of the casino, the auction item may be delivered to the player at the delivery or other designated address provided by the player.

If a player is not the highest bidder on an auction item, the player's bid amount may be returned to the player, or the player's bid amount may go to the casino. If the player's bid amount is returned to the player, the bid amount may be retuned in the form of game credits, cash, tokens and/or points associated with a player tracking system. In one embodiment, the bid amount is returned in the form of a consolation prize, such as a t-shirt provided by the gaming establishment. Alternatively, the bid amount may be returned in the form of a coupon or promotion for goods and/or services offered by a participating entity, such as a third-party retailer or the casino. In one embodiment, the player's bid amount (or portion thereof) funded via awards are returned to the player and the player's bid amount (or portion thereof) funded via wagers are forfeited to a gaming establishment, such as a casino.

In one embodiment, if the player supplemented the player's auction bid (or a portion thereof) and the auction bid is not the winning auction bid, the amount supplemented by the player is forfeited to the gaming establishment. Alternatively, the amount supplemented by the player (or a portion thereof) is returned to the player or the player is provided with an alternative value, such as a t-shirt, provided by the gaming establishment.

For the present disclosure, it should be appreciated that the auction items and/or bid amounts for those auction items may be specific to one or more individual gaming devices and/or specific to one or more individual players. In one embodiment, one or more auction items are displayed on a first gaming device 10 while at least one other auction item is displayed on a second gaming device 10. In another embodiment, one or more auction items are displayed to a first player while at least one other auction item is displayed to a second player. For example, at least one certain auction item (e.g., an auction item with a high value) is displayed on a certain gaming device (e.g., a gaming device with a high amount or a predetermined amount of coin-in) and/or displayed to a certain player (e.g., a player with a high player status or a predetermined player status as determined through a player tracking system) and the certain auction item is not displayed on other gaming devices (e.g., a gaming device with a low amount of coin-in) and/or to other players (e.g., a player with a low player status or no player status as determined through a player tracking system).

In different embodiments, the determination of whether a certain auction item is displayed on a certain gaming device and/or displayed to a certain player is predetermined, randomly determined, determined or weighted based on the player's wager or bid amount, determined or weighted based on the status of one or more players (such as determined through a player tracking system), determined based on time, determined based on an outcome generated in a primary game or a bonus game, determined based on any combination of these factors, or determined based on any other suitable method. For example, an auction item is displayed on each gaming device 10 that has received $100 in coin-in during a predetermined time period, such as 30 minutes. Alternatively, the gaming device 10 displays an auction item to each player having a predetermined wager amount or wager level (such as a maximum wager) or a predetermined rate of play (such as 5 credits per minute).

In certain embodiments, the gaming device enables a plurality of players to win an auction item for the same auction. For example, if two players are the highest bidders, the system provides the auction item to the two players. The two players may tie for the highest bid by having the same bid amount (e.g., $20.00). In such an instance, the gaming device provides the auction item to each of the tied players associated with the winning bid. However, in one embodiment, a tie-breaker could be used to determine the high bidder. One example of a tie-breaker is based on player status as determined by a player tracking system. In such an instance, the player with the highest status, such as platinum, is determined to be the high bidder and winner of the auction item.

In an alternative embodiment, the gaming device determines a plurality of players having the highest bids from amongst the players. For example, if an auction for a watch ends with four bids of $20.00, $19.75, $19.00 and $18.50, the gaming device provides the players who bid $20.00 and $19.75 with the auction item. In this example, the highest bidders need not have bid the same amount. In another embodiment, the auction is provided as a "Dutch" auction in which a plurality of identical auction items are auctioned simultaneously to an equal number of high bidders. The high bidders may or may not bid the same amounts to win an auction item in the "Dutch" auction. Based on the above example, if the "Dutch" auction includes three watches, the gaming device provides the players that bid $20.00, $19.75 and $19.00 with a watch.

In one embodiment, the bid amounts for one or more auction items are associated with individual gaming devices instead of individual players. For example, different players who participate in the same auction from the same gaming device at different times contribute to the same bid amount. In such an instance, a first player bids on an auction item on a first gaming device. The first player accumulates a bid totaling $100 for the auction item. If the first player leaves the first gaming device 10 before the auction for the auction item ends, another player may participate in the auction. The bid amount $100 is not returned to the first player in this embodiment. Instead, the bid amount $100 is associated with the first gaming device so that if a second player plays at the first gaming device, the second player is enabled to build upon the bid amount accumulated by the first player. If the second player wins the auction, the auction item is provided to the second player. In one embodiment, the gaming device indicates auction items previously bid on by the first player differently than other auction items. In another embodiment, the gaming device indicates auction items previously bid on by the first player in the same manner as other auction items.

In another embodiment, the bid amounts for one or more auction items are associated with individual players instead of individual gaming devices. For example, a player who participates in the same auction from different gaming devices (or at the same gaming device at a different time) contributes to the same bid amount. In such an instance, a player bids on an auction item on a first gaming device. The first player accumulates a bid totaling $50 for the auction item. If the first player leaves the first gaming device before the auction for the auction item ends, the first player may participate in the auction from a second gaming device (or the first gaming device at a later time). The bid amount $50 is not returned to the first player in this embodiment. Instead, the bid amount $50 is associated with the first player so that if the first player plays at the second gaming device (or the first gaming device at a later time), the first player is enabled to build upon the bid amount previously accumulated at the first gaming device. If the first player wins the auction, the auction item is provided to the first player. As described above, the gaming device may or may not indicate auction items previously bid on by the first player differently than other auction items.

In one embodiment, the gaming device 10 communicates with one or more of the auction servers 302 to provide auction related features to a plurality of players. The auction related features may be provided independent and separate from game play on the gaming device 10. In such an instance, the bid amounts for auction items are only funded with points associated with a player tracking system. The gaming device may provide a plurality of auction items to the player and enable the player to choose to pursue one or more auction items. The player bids on one or more selected auction items and the gaming device provides the selected auction item(s) to the player if the player is the highest bidder when the auction(s) end. The points used to fund the bid amounts on auction items may be stored and retrieved from a player tracking account and/or a player reward card associated with the player tracking system. In certain embodiments, the player earns such points through game play on a gaming device, through participation in other gaming activities at the gaming establishment, such as blackjack, roulette or other games and/or through participation in activities, such as purchasing goods and/or services, at the gaming establishment. Additionally, the player may earn points through other suitable methods, such through participation in promotional or marketing activities associated with the gaming establishment. Any points earned by the player may be matched by the gaming establishment. The matched points are applied to the player's account. For example, a player may be given a 2-for-1 promotion that temporarily doubles the amount of points attributed to the player's account (e.g., 2 points instead of 1 point). The promotion may be awarded to the player in any suitable manner. For example, the promotion may be awarded via the gaming device as part of a bonus game or presented to the player via the gaming device based on the player's identity or status as determined from a frequent player card or a player tracking system. The matching may be performed during a certain promotional time period, for certain promotional gaming devices and/or for certain players. The matched funds may be limited to or set within a predetermined minimum (e.g., 1% of each wager and/or award or $0.01) and/or a predetermined maximum (e.g., 5% of each wager and/or award or $0.05).

In certain embodiments, the auction related features are only provided to players having a certain status (as determined through a player tracking system). For example, only players with a high status, such as those players with a platinum or gold status may participate in the auction related features while other players, such as those players with a bronze status or those players with no status, may not participate in the auction related features. Eligibility to participate in the auction related features may be based, at least in part, on other factors, such as a predetermined wager level (e.g., a maximum wager), time, a side-bet or a side-wager, a random determination by the auction server (or other device) and/or any other suitable factor.

In an additional embodiment, the bid amounts for one or more auction items are associated with an award that is provided to a player after a suitable triggering event. The auction server (or other device) selects one or more players to receive an award after the suitable triggering event. In one embodiment, the auction server (or other device) selects one or more gaming devices to provide the award to a player at the selected gaming device(s) after the suitable triggering event. The triggering event may be random, predetermined, based on a player's wagers, based on time or otherwise determined in any suitable manner desired by the game implementer or operator.

In such an instance, the gaming device and/or the auction server (or other device) does not provide any apparent reasons to the player(s) for obtaining such awards. Since the player(s) do not know when the triggering event will occur, the obtainment of such awards appears random to the player(s). In this embodiment, the awards are not triggered by an event in or based specifically on any of the plays of the gaming devices. That is, the gaming devices may simply provide the award(s) to one or more players without any explanation or alternatively with simple explanations such as "You Have Won a Bonus Award of $_____." Such explanations and other information may be delivered to the player(s) via signals or messages (e.g., via gaming machines) containing such explanations or information or through other suitable audio/visual output.

If the gaming device and/or the auction server (or other device) determines to provide a player with an award after a suitable triggering event, the award (or a portion thereof) is allocated to the player's bid amount for an auction item. In certain embodiments, the portion of the award that is allocated to the player's bid amount for an auction item is selected by the player, selected by the gaming device and/or the auction server, predetermined, randomly determined or determined in any other suitable manner.

In an alternative embodiment, the gaming device and/or the auction server (or other device) provides the auction related features to one or more players after a suitable triggering event. As described above, the triggering event may be random, predetermined, based on a player's wagers, based on time or otherwise determined in any suitable manner desired by the game implementer or operator. In such an instance, the auction server (or other device) selects one or more players after a suitable triggering event and enables the one or more selected players to participate in at least one auction for one or more auction items. In one embodiment, the triggering event is triggered by an event in or based on any of the plays of any primary game or on any of the plays of any secondary game of the gaming devices. For example, the triggering event includes a random occurrence of a predetermined symbol or a predetermined combination of symbols (e.g., a symbol combination including a plurality of bonus symbols) in a play of the gaming device. That is, the triggering event is symbol driven. After a player obtains the predetermined symbol or the predetermined combination of symbols in a play of the gaming device, the gaming device enables the player to participate in the auction related features. In one embodiment, the gaming device enables a plurality of players to participate in the auction related features simultaneously.

In another embodiment, the triggering event includes a random trigger number selected from a range of numbers. When the game is commenced, each game/player is allotted numbers from the same number range from which the random number was selected. That is, prior to each primary game, the auction server (or other device) selects a random number from a range of numbers and during each primary game, the auction server (or other device) allocates N number(s) in the range to the plurality of players. The previously selected random number is compared with the N number(s) allotted to the player(s). If there is a match between the trigger number and one of the player's allotted numbers, the auction server (or other device) determines that the triggering event will occur and causes the triggering event to occur. After the triggering event occurs, the gaming device enables the player to participate in the auction related features. In one embodiment, the gaming device enables a plurality of players to participate in the auction related features simultaneously.

In one embodiment, the triggering event includes a random trigger number selected from a range of numbers. When the game is commenced, each game/player is allotted numbers from the same number range from which the random number was selected, wherein one number in the range is allotted for each credit bet such that the player's probability of being awarded any award(s) is proportional to the wager amount. That is, prior to each primary game, the auction server (or other device) selects a random number from a range of numbers and during each primary game, the auction server (or other device) allocates the first N numbers in the range to each player, where N is the number of credits bet by the player in that primary game. The previously selected random number is compared with the N numbers allotted to the player(s). If there is a match between the trigger number and one of the player's allotted numbers, the auction server (or other device) determines that the triggering event will occur and causes the triggering event to occur. After the triggering event occurs, the gaming device enables the player to participate in the auction related features. In one embodiment, the gaming device enables a plurality of players to participate in the auction related features simultaneously.

In one embodiment, the auction server (or other device) maintains one or more trigger values that are each associated with a separate range of values. In this embodiment, a triggering event will occur when the trigger value increments or increases to a value (i.e., a trigger hit value) within the range of values associated with that trigger value. For example, a triggering event will occur when the trigger value for a player's bid amount increments to a trigger hit value of $500. The trigger hit values can be randomly selected, predetermined or otherwise determined by the game implementer or operator. In such an instance, if the player's bid amount reaches $500, the auction server (or other device) provides an additional award to the player. If the player has designated or allocated a portion of each win and/or each award to the player's bid amount, the player's bid amount is increased by the designated portion or percentage (e.g., 5%) of the additional award.

In one embodiment, the gaming device enables a plurality of players to be provided the additional award simultaneously.

In summary, methods and apparatus for auctioning an item via a gaming device have been provided. The foregoing description has been presented for the purposes of illustration and description. It is not intended to be exhaustive or to limit the invention to the exemplary embodiments disclosed. Many modifications and variations are possible in light of the above teachings. It is intended that the scope of the invention be limited not by this detailed description of examples, but rather by the claims appended hereto.

The invention is claimed as follows:

1. A gaming device operable under control of a processor, said gaming device comprising:

a display device operatively coupled to the processor; and an input device operatively coupled the processor, wherein the processor is programmed to:

cause the display device to display an image indicative of at least one auction item;

enable selection of the auction item via the input device;

cause a plurality of plays of at least one wagering game;

for each of at least one of the plays of the at least one wagering game, allocate a bid portion of at least one of a wager amount and a winning outcome amount to a bid on the selected auction item; and if the bid is a winning bid for the auction item, said winning bid selected from a plurality of competing bids including the bid, cause the auction item associated with the winning bid to be provided a player.

2. The gaming device of claim 1, wherein the processor is programmed to receive an amount, the bid portion being based on the received amount.

3. The gaming device of claim 1, wherein the processor is programmed to receive a percentage, the bid portion being based on the received percentage.

4. The gaming device of claim 1, wherein the processor is programmed to allocate the bid portion to a plurality of auction items in series.

5. The gaming device of claim 1, wherein the processor is programmed to allocate the bid portion to a plurality of auction items in parallel.

6. The gaming device of claim 1, wherein the processor is programmed to receive a minimum bid amount associated with the auction item.

7. The gaming device of claim 1, wherein the processor is programmed to receive a maximum bid amount associated with the auction item.

8. The gaming device of claim 1, wherein the processor is programmed to cause the display device to display at least one of a bid amount, a rank, an accumulation of wager amounts, a number of bids, a time remaining to bid on the auction item, a maximum bid amount associated with the auction item, a minimum bid amount associated with the auction item, an acceptable bid amount associated with the auction item, and a number of wagering games played.

9. The gaming device of claim 1, which includes a printer operatively coupled to the processor, the printer configured to print a receipt indicative of the auction item.

10. The gaming device of claim 1, wherein, if the bid is a losing bid, the processor is programmed to return at least a portion of the bid to the player.

11. The gaming device of claim 1, wherein, if the bid is a losing bid, the processor is programmed to forfeit at least a portion of the bid to a gaming establishment.

12. The gaming device of claim 1, wherein, if the bid portion of at least one wager amount is allocated to the bid and the bid is a losing bid, the processor is programmed to return at least a portion of the bid to the player.

13. The gaming device of claim 1, wherein, if the bid portion of at least one wager amount is allocated to the bid and the bid is a losing bid, the processor is programmed to forfeit at least a portion of the bid to a gaming establishment.

14. The gaming device of claim 1, wherein, if the bid portion of at least one winning outcome is allocated to the bid and the bid is a losing bid, the processor is programmed to return at least a portion of the bid to the player.

15. The gaming device of claim 1, wherein, if the bid portion of at least one winning outcome is allocated to the bid and the bid is a losing bid, the processor is programmed to forfeit at least a portion of the bid to a gaming establishment.

16. The gaming device of claim 1, wherein the processor is programmed to enable the player to supplement the bid with at least one of: (a) one or more game credits, (b) an amount of cash, (c) one or more tokens, and (d) one or more points associated with a player tracking system.

17. The gaming device of claim 1, which includes a display case configured to display one or more physical auction items.

18. The gaming device of claim 1, wherein the processor is programmed to enable selection of a plurality of different auction items.

19. The gaming device of claim 1, wherein the processor is programmed to generate an output indicating a status of the auction item.

20. A gaming device operated under control of a processor, said gaming device comprising:

a display device operatively coupled to the processor;

a printer operatively coupled to the processor; and an input device operatively coupled the processor, wherein the processor is programmed to:

receive a bid percentage;

cause the display device to display an image indicative of at least one auction item;

enable selection of the auction item via the input device;

receive a maximum bid amount associated with the auction item;

cause a plurality plays of at least one wagering game;

if the maximum bid amount is not received, allocate a bid portion of at least one of a wager amount and a winning outcome amount to a bid on the selected auction item based on the bid percentage;

cause the display device to show an auction rank associated with the auction item and a plurality of competing bids including the bid; and cause the printer to print a receipt indicative of the auction item if at least one of: (i) the bid is a winning bid selected from the plurality of competing bids including the bid; and (ii) the bid reaches a maximum bid amount.

21. The gaming device of claim 20, wherein the processor is programmed to allocate the bid to a plurality of auction items.

22. The gaming device of claim 21, wherein the processor is programmed to allocate a first bid portion to one auction item and a second bid portion to another auction item.

23. The gaming device of claim 22, wherein the first bid portion is different from the second bid portion.

24. The gaming device of claim 20, wherein the processor is programmed to receive a minimum bid amount or a maximum bid amount associated with the auction item.

25. The gaming device of claim 20, wherein the processor is programmed to cause the display device to display at least one of a bid amount, a rank, an accumulation of wager amounts, a number of bids, a time remaining to bid on the auction item, a maximum bid amount associated with the auction item, a minimum bid amount associated with the auction item, an acceptable bid amount associated with the auction item, and a number of wagering games played.

26. The gaming device of claim 20, wherein, if the bid is a losing bid, the processor is programmed to return at least a portion of the bid to the player.

27. The gaming device of claim 20, wherein, if the bid is a losing bid, the processor is programmed to forfeit at least a portion of the bid to a gaming establishment.

28. The gaming device of claim 20, wherein, if the bid portion of at least one wager amount is allocated to the bid and the bid is a losing bid, the processor is programmed to return at least a portion of the bid to a player.

29. The gaming device of claim 20, wherein, if the bid portion of at least one wager amount is allocated to the bid and the bid is a losing bid, the processor is programmed to forfeit at least a portion of the bid to a gaming establishment.

30. The gaming device of claim 20, wherein, if the bid portion of at least one winning outcome is allocated to the bid and the bid is a losing bid, the processor is programmed to return at least a portion of the bid to a player.

31. The gaming device of claim 20, wherein, if the bid portion of at least one winning outcome is allocated to the bid and the bid is a losing bid, the processor is programmed to forfeit at least a portion of the bid to a gaming establishment.

32. The gaming device of claim 20, wherein the processor is programmed to enable the player to supplement the bid with at least one of: (a) one or more game credits, (b) an amount of cash, (c) one or more tokens and (d) one or more points associated with a player tracking system.

33. The gaming device of claim 20, which includes a display case configured to display one or more physical auction items.

34. The gaming device of claim 20, wherein the processor is programmed to enable selection of a plurality of different auction items.

35. The gaming device of claim 20, wherein the processor is programmed to generate an output indicating a status of the auction item.

* * * * *

UNITED STATES PATENT AND TRADEMARK OFFICE

CERTIFICATE OF CORRECTION

PATENT NO. : 7,905,777 B2
APPLICATION NO. : 11/461964
DATED : March 15, 2011
INVENTOR(S) : David H. Muir It is certified that error appears in the above-identified patent and that said Letters Patent is hereby corrected as shown below:

In Claim 20, column 38, line 52, replace “a maximum bid” with --the maximum bid--.

In Claim 24, column 38, lines 63 to 64, replace “a maximum bid” with --the maximum bid--.

In Claim 25, column 39, line 2, replace “a maximum bid” with --the maximum bid--.

Signed and Sealed this
Tenth Day of May, 2011

David J. Kappos

David J. Kappos
*Director of the United States Patent and Trademark Office*